US012173964B2

(12) United States Patent
Cao et al.

(10) Patent No.: US 12,173,964 B2
(45) Date of Patent: Dec. 24, 2024

(54) AIR CONDITIONER

(71) Applicant: Qingdao Hisense Hitachi Air-Conditioning Systems Co., Ltd., Shandong (CN)

(72) Inventors: Fali Cao, Shandong (CN); Yuping Deng, Shandong (CN); Xiaolei Liu, Shandong (CN); Yazhou Tang, Shandong (CN); Heng Zhang, Shandong (CN)

(73) Assignee: QINGDAO HISENSE HITACHI AIR-CONDITIONING SYSTEMS CO., LTD., Qingdao (CN)

( * ) Notice: Subject to any disclaimer, the term of this patent is extended or adjusted under 35 U.S.C. 154(b) by 268 days.

(21) Appl. No.: 17/748,216

(22) Filed: May 19, 2022

(65) Prior Publication Data

US 2022/0276009 A1 Sep. 1, 2022

Related U.S. Application Data

(63) Continuation of application No. PCT/CN2019/125182, filed on Dec. 13, 2019.

(30) Foreign Application Priority Data

Nov. 20, 2019 (CN) ..... 201911141833.9

(51) Int. Cl.
*F28D 1/053* (2006.01)
*F28D 21/00* (2006.01)
(Continued)

(52) U.S. Cl.
CPC ..... *F28D 1/05391* (2013.01); *F28D 21/00* (2013.01); *F28F 1/022* (2013.01);
(Continued)

(58) Field of Classification Search
CPC ..... F28D 1/05391; F28D 21/00; F28D 2021/0068; F28F 1/022; F28F 9/0204; F28F 9/0278
See application file for complete search history.

(56) References Cited

U.S. PATENT DOCUMENTS 2,733,899 A * 2/1956 Lehmann ..... F28F 9/0217 165/150
5,479,985 A * 1/1996 Yamamoto ..... F28D 1/05391 165/176
(Continued)

FOREIGN PATENT DOCUMENTS

CN 103348212 A 10/2013
CN 103946665 A 7/2014
(Continued)

OTHER PUBLICATIONS

International Search and Written Opinion issued in corresponding International Patent Application No. PCT/CN2019/125182 dated Aug. 12, 2020, with English translation.
(Continued)

*Primary Examiner* — Raheena R Malik
(74) *Attorney, Agent, or Firm* — Morgan, Lewis & Bockius LLP

(57) ABSTRACT

An air conditioner includes a plurality of flat tubes, a first header, a second header, a third header and a connecting pipe. The plurality of flat tubes are configured to circulate a gas-liquid two-phase refrigerant. The first header is disposed at an end of the plurality of flat tubes. The second header is disposed at another opposite end of the plurality of flat tubes, and includes a header body and at least one flow disturbing portion. The at least one flow disturbing portion is disposed in the header body and configured to disturb a flow of the gas-liquid two-phase refrigerant in the header body. The third header is disposed at the another opposite end of the
(Continued)

plurality of flat tubes. The connecting pipe communicates with the header body of the second header and the third header.

20 Claims, 17 Drawing Sheets

(51) Int. Cl.
*F28F 1/02* (2006.01)
*F28F 9/02* (2006.01)

(52) U.S. Cl.
CPC ..... *F28F 9/0204* (2013.01); *F28F 9/0278* (2013.01); *F28D 2021/0068* (2013.01)

(56) References Cited

U.S. PATENT DOCUMENTS

| | | | | |
|---|---|---|---|---|
| 6,082,448 | A * | 7/2000 | Haussmann | F28D 1/05391 165/158 |
| 10,041,710 | B2 * | 8/2018 | Morimoto | F28F 27/02 |
| 10,443,944 | B2 * | 10/2019 | Inoue | F25B 39/00 |
| 10,907,903 | B2 * | 2/2021 | Morimura | F28F 9/0263 |
| 11,846,472 | B2 * | 12/2023 | Watanabe | F25B 39/00 |
| 2010/0314090 | A1 * | 12/2010 | Moriya | F25B 41/00 165/173 |
| 2013/0306285 | A1 | 11/2013 | Jindou et al. | |
| 2014/0338874 | A1 * | 11/2014 | Jindou | F28F 9/0207 165/173 |
| 2016/0169596 | A1 * | 6/2016 | Jindou | F25B 39/00 62/526 |
| 2016/0238322 | A1 | 8/2016 | Inoue et al. | |
| 2016/0320135 | A1 | 11/2016 | Inoue et al. | |
| 2017/0211886 | A1 * | 7/2017 | Morimura | F28F 9/027 |
| 2022/0099374 | A1 * | 3/2022 | Hirokawa | F28D 1/053 |
| 2022/0155016 | A1 * | 5/2022 | Yamada | F28D 1/05391 |
| 2023/0194191 | A1 * | 6/2023 | Takahashi | F28D 1/05391 165/175 |

FOREIGN PATENT DOCUMENTS

| | | | |
|---|---|---|---|
| CN | 203928496 | U | 11/2014 |
| CN | 104344607 | A | 2/2015 |
| CN | 204943973 | U | 1/2016 |
| CN | 105849498 | A | 8/2016 |
| CN | 209042811 | U | 6/2019 |
| CN | 210980114 | U | 7/2020 |
| EP | 2 660 550 | A1 | 11/2013 |
| EP | 2 778 595 | A1 | 9/2014 |
| EP | 3 088 832 | A1 | 11/2016 |
| EP | 3 203 175 | A1 | 8/2017 |
| JP | 2015-055412 | A | 3/2015 |
| KR | 10-2008-0107024 | A | 12/2008 |
| KR | 20190096170 | A | 8/2019 |

OTHER PUBLICATIONS

Extended European Search Report issued on Oct. 17, 2023 in the related European Patent Application No. 19953343.1.
Office Action issued on May 28, 2024 in Chinese Patent Application No. 201911141833.9 with English translation.

* cited by examiner

H1-H1

H2-H2

H3-H3

AIR CONDITIONER

CROSS-REFERENCE TO RELATED APPLICATIONS

This application is a continuation application of International Application No. PCT/CN2019/125182, filed on Dec. 13, 2019, which claims priority to Chinese Patent Application No. 201911141833.9, filed on Nov. 20, 2019, the entire contents of which are incorporated herein by reference in their entireties.

TECHNICAL FIELD

The present disclosure relates to the field of air conditioning technologies, and in particular, to an air conditioner.

BACKGROUND

At present, heat pump air conditioners are one of the most commonly used kinds of heating and cooling air conditioners. When cooling in summer, the air conditioner cools down the air indoors and dissipates heat outdoors; and when heating in winter, it heats up the air indoors and cools down the air outdoors, which is opposite to how it is in summer. Air conditioners exchange heat and cold between different environments through heat pumps. For example, in winter, the outdoor air, the surface water, and underground water are low-temperature heat sources, while the indoor air is a high-temperature heat source. The principle of the heat pump air conditioner heating objects is to transfer heat from an outdoor low-temperature environment to a high-temperature indoor environment.

SUMMARY

An air conditioner is provided. The air conditioner includes a plurality of flat tubes, a first header, a second header, a third header and a connecting pipe. The plurality of flat tubes are configured to circulate a gas-liquid two-phase refrigerant. A flow direction of the gas-liquid two-phase refrigerant in a first part of the plurality of flat tubes is opposite to a flow direction of the gas-liquid two-phase refrigerant in a second part of the plurality of flat tubes. The first header is disposed at an end of the plurality of flat tubes. The second header is disposed at another opposite end of the plurality of flat tubes, and includes a header body and at least one flow disturbing portion. The header body communicates with the first part of flat tubes. The at least one flow disturbing portion is disposed in the header body and configured to disturb a flow of the gas-liquid two-phase refrigerant in the header body. The third header is disposed at the another opposite end of the plurality of flat tubes and communicates with the second part of flat tubes. The connecting pipe communicates with the header body of the second header and the third header.

BRIEF DESCRIPTION OF THE DRAWINGS

In order to describe technical solutions in the present disclosure more clearly, accompanying drawings to be used in some embodiments of the present disclosure will be introduced briefly below. However, the accompanying drawings to be described below are merely accompanying drawings of some embodiments of the present disclosure, and a person of ordinary skill in the art may obtain other drawings according to these drawings. In addition, the accompanying drawings to be described below may be regarded as schematic diagrams, and are not limitations on actual sizes of products, actual processes of methods and actual timings of signals to which the embodiments of the present disclosure relate.

DETAILED DESCRIPTION

Figure 1:
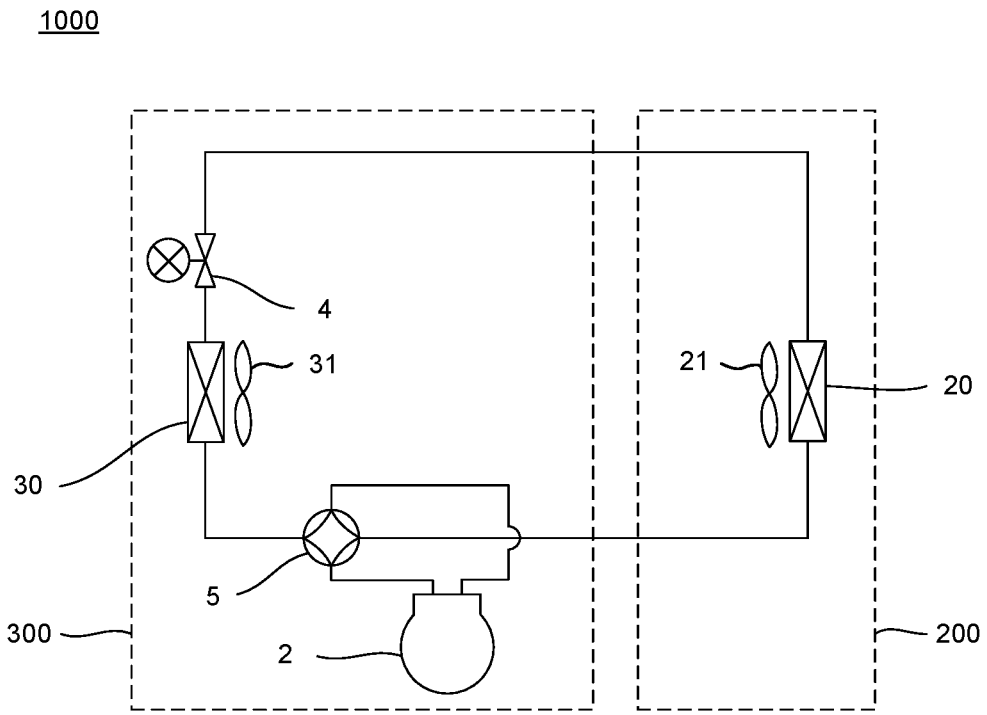
FIG. 1 is a schematic diagram of an air conditioner, in accordance with some embodiments.

Technical solutions in some embodiments of the present disclosure will be described clearly and completely with reference to the accompanying drawings below. Obviously, the described embodiments are merely some but not all embodiments of the present disclosure. All other embodiments obtained by a person of ordinary skill in the art based on the embodiments of the present disclosure shall be included in the protection scope of the present disclosure.

Unless the context requires otherwise, throughout the specification and the claims, the term "comprise" and other forms thereof such as the third-person singular form "comprises" and the present participle form "comprising" are construed as being open and inclusive, meaning "including, but not limited to". In the description, the terms such as "one embodiment", "some embodiments", "exemplary embodiments", "example", "specific example" or "some examples" are intended to indicate that specific features, structures, materials, or characteristics related to the embodiment(s) or example(s) are included in at least one embodiment or example of the present disclosure. Schematic representations of the above terms do not necessarily refer to the same embodiment(s) or example(s). In addition, the specific features, structures, materials or characteristics may be included in any one or more embodiments or examples in any suitable manner.

Hereinafter, the terms "first" and "second" are used for descriptive purposes only, and are not to be construed as indicating or implying the relative importance or implicitly indicating the number of indicated technical features. Thus, features defined as "first" and "second" may explicitly or implicitly include one or more of the features. In the description of the embodiments of the present disclosure, the term "a/the plurality of" means two or more unless otherwise specified.

In the description of some embodiments, the term "coupled" and "connected" and their derivatives may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact. However, the term "coupled" or "communicatively coupled" may also mean that two or more components are not in direct contact with each other, but still cooperate or interact with each other. The embodiments disclosed herein are not necessarily limited to the contents herein.

The phrase "at least one of A, B and C" has a same meaning as the phrase "at least one of A, B or C", and they both include the following combinations of A, B and C: only A, only B, only C, a combination of A and B, a combination of A and C, a combination of B and C, and a combination of A, B and C.

The use of the phrase "applicable to" or "configured to" herein means an open and inclusive language, which does not exclude devices that are applicable to or configured to perform additional tasks or steps.

The term such as "about", "substantially" or "approximately" as used herein includes a stated value and an average value within an acceptable range of deviation of a particular value. The acceptable range of deviation is determined by a person of ordinary skill in the art, considering measurement in question and errors associated with measurement of a particular quantity (i.e., limitations of a measurement system).

The term such as "parallel", "perpendicular" or "equal" as used herein includes a stated condition and a condition similar to the stated condition. A range of the similar condition is within an acceptable deviation range, and the acceptable deviation range is determined by a person of ordinary skill in the art, considering measurement in question and errors associated with measurement of a particular quantity (i.e., limitations of a measurement system). For example, the term "parallel" includes absolute parallelism and approximate parallelism, and an acceptable deviation range of the approximate parallelism may be, for example, a deviation within 5°. The term "perpendicular" includes absolute perpendicularity and approximate perpendicularity, and an acceptable deviation range of the approximate perpendicularity may also be, for example, a deviation within 5°. The term "equal" includes absolute equality and approximate equality, and an acceptable deviation range of the approximate equality may be that, for example, a difference between the two that are equal is less than or equal to 5% of either of the two.

FIG. 1 is a schematic diagram of an air conditioner, in accordance with some embodiments. As shown in FIG. 1, the air conditioner 1000 includes an air conditioner indoor unit 200 and an air conditioner outdoor unit 300. The air conditioner indoor unit 200 is connected to the air conditioner outdoor unit 300 through pipelines, so as to transmit a gas-phase refrigerant, a liquid-phase refrigerant and a gas-liquid two-phase refrigerant. The air conditioner indoor unit 200 includes an indoor heat exchanger 20 and an indoor fan 21. The air conditioner outdoor unit 300 includes a compressor 2, a four-way reversing valve 5, an outdoor heat exchanger 30, an outdoor fan 31 and an expansion valve 4. The compressor 2 is configured to compress the gas-phase refrigerant, so that the gas-phase refrigerant with low pressure is compressed to be a gas refrigerant with high pressure.

The outdoor heat exchanger 30 is configured to perform heat-exchange between outdoor air and the gas-liquid two-phase refrigerant transmitted in the outdoor heat exchanger 30.

The outdoor fan 31 is configured to induce the outdoor air into the air conditioner outdoor unit 300 through an outdoor air inlet of the air conditioner outdoor unit 300, and send the outdoor air, after heat-exchange between the outdoor air and the outdoor heat exchanger 30, out through an outdoor air outlet of the air conditioner outdoor unit 300. The outdoor fan 31 provides power for the flow of the outdoor air.

The expansion valve 4 is connected between the outdoor heat exchanger 30 and the indoor heat exchanger 20. A pressure of the gas-phase refrigerant flowing between the outdoor heat exchanger 30 and the indoor heat exchanger 20 is adjusted by an opening degree of the expansion valve 4, so as to adjust the flow rate of the gas-liquid two-phase refrigerant between the outdoor heat exchanger 30 and the indoor heat exchanger 20. A flow rate of the gas-liquid two-phase refrigerant flowing between the outdoor heat exchanger 30 and the indoor heat exchanger 20 and a pressure of the gas-phase refrigerant flowing between the outdoor heat exchanger 30 and the indoor heat exchanger 20 will affect the heat-exchange performance of the outdoor heat exchanger 30 and the indoor heat exchanger 20. The expansion valve 4 may be an electronic valve. The opening degree of the expansion valve 4 is adjustable, so as to control the flow rate of the gas-liquid two-phase refrigerant flowing through the expansion valve 4 and the pressure of the gas-phase refrigerant flowing through the expansion valve 4.

The four-way reversing valve 5 is configured to switch a flow direction of the gas-liquid two-phase refrigerant in the air conditioner 1000, so as to enable the air conditioner 1000 to perform a cooling mode or a heating mode.

The indoor heat exchanger 20 is configured to perform heat-exchange between indoor air and the gas-liquid two-phase refrigerant transmitted in the indoor heat exchanger 20.

The indoor fan 21 is configured to induce the indoor air into the air conditioner indoor unit 200 through an indoor air inlet of the air conditioner indoor unit 200, and send the indoor air, after heat-exchange between the indoor air and the indoor heat exchanger 20, out through an indoor air outlet of the air conditioner indoor unit 200. The indoor fan 21 provides power for the flow of the indoor air.

Figure 2:
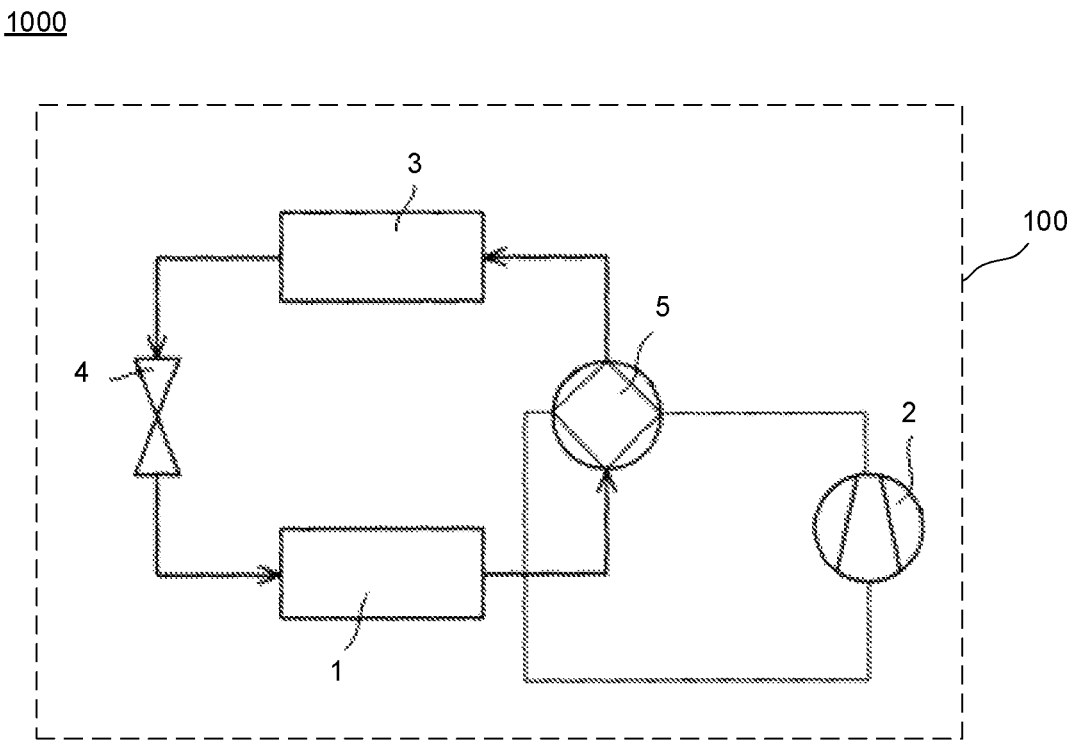
FIG. 2 is a diagram showing a principle of a heating cycle of an air conditioner, in accordance with some embodiments.

FIG. 2 is a diagram showing a principle of a heating cycle of an air conditioner, in accordance with some embodiments. As shown in FIG. 2, the air conditioner 1000 includes a heat pump air conditioner. The air conditioner 1000 includes a heat exchange loop 100. The heat exchange loop 100 is configured to exchange heat between indoors and outdoors, so as to achieve a regulation of indoor temperature by the air conditioner 1000.

The heat exchange loop 100 includes an evaporator 1, the compressor 2, a condenser 3, the expansion valve 4 and the four-way reversing valve 5. A phase change process of the gas-liquid two-phase refrigerant in the evaporator 1 is reverse to that of the gas-liquid two-phase refrigerant in the condenser 3.

In a working condition of heating, the outdoor heat exchanger 30 is used as the evaporator 1, and the indoor heat exchanger 20 is used as the condenser 3. At this time, the gas-liquid two-phase refrigerant absorbs heat from the outdoor environment through the outdoor heat exchanger 30, and releases heat to the indoor environment to achieve a purpose of indoor heating.

In the working condition of heating, a heating process of the air conditioner 1000 includes the following: first, the gas-liquid two-phase refrigerant with a low temperature and a low pressure (i.e., a mixture of the liquid-phase refrigerant and the gas-phase refrigerant) in the evaporator 1 absorbs heat from the outdoor environment with a low temperature; the gas-liquid two-phase refrigerant is sucked in by the compressor 2 and is compressed into a gas refrigerant with a high temperature and a high pressure; then, the gas refrigerant with the high temperature and the high pressure releases heat into an indoor environment at the condenser 3, and the temperature of the gas refrigerant decreases; finally, the gas refrigerant is throttled through the expansion valve 4, and becomes a gas-liquid two-phase refrigerant with a low temperature and a low pressure, which reenters the evaporator 1; and the heating process of the above cycle is repeated. In a working condition of cooling, the air conditioner 1000 changes the working condition by changing the flow direction of the gas-liquid two-phase refrigerant, while the changing of the flow direction of the gas-liquid two-phase refrigerant is achieved by changing a position of a valve block of the four-way reversing valve 5. The indoor heat exchanger 20 is used as the evaporator 1 and the outdoor heat exchanger 30 is used as the condenser 3. The indoor air is cooled down through a surface of the evaporator 1, so as to achieve a purpose of lowering an indoor temperature, and heat is transported to the outdoor environment through the condenser 3.

The evaporator 1 is a device that outputs cold, and is configured to evaporate the liquid-phase refrigerant flowing into the evaporator 1 through the expansion valve 4, so as to absorb the heat of an object to be cooled and achieve a purpose of refrigeration. The condenser 3 is a device that outputs heat. The condenser 3 is configured to condense the gas-phase refrigerant flowing from the evaporator 1 into the condenser 3, and the heat absorbed from the evaporator 1 together with the heat converted from the work consumed by the compressor 2 is released, so as to achieve a purpose of heating. The evaporator 1 and the condenser 3 are important parts of heat-exchange in the air conditioner 1000, and their performance will directly determine the performance of the entire refrigeration system.

Of course, the principle of the heat-exchange of the air conditioner 1000 is not limited thereto.

In some embodiments, the structure of the evaporator 1 is the same as the structure of the condenser 3, except that the inflow end and outflow end of the gas-liquid two-phase refrigerant in the evaporator 1 are opposite to that of the gas-liquid two-phase refrigerant in the condenser 3. Hereinafter, the evaporator 1 and the condenser 3 are collectively referred to as a heat exchanger 6.

In general, compared with a finned tube heat exchanger, a microchannel heat exchanger has significant advantages in terms of material cost, gas-liquid two-phase refrigerant charge and heat flux density, which is in line with the development trend of energy conservation and environmental protection of heat exchangers. The microchannel heat exchanger includes flat tubes, fins, headers and end caps. Separating baffles are further inserted into the headers of a multi-flow microchannel heat exchanger. The separating baffles divide the headers into a plurality of independent header cavities, and each header cavity communicates with a certain number of flat tubes. In a case where the microchannel heat exchanger is used as an evaporator, when a gas-liquid two-phase refrigerant enters a plurality of flat tubes from the header cavity, the flowing gas-liquid two-phase refrigerant is easily separated due to gravity and viscous force (there is a difference in density and viscosity between the gas phase and the liquid phase), causing the gas-liquid two-phase refrigerant to be non-uniform in the plurality of the flat tubes. The non-uniformity of the gas-liquid two-phase refrigerant not only deteriorates the heat-exchange efficiency, but also causes fluctuations in the refrigeration system.

Figure 3:
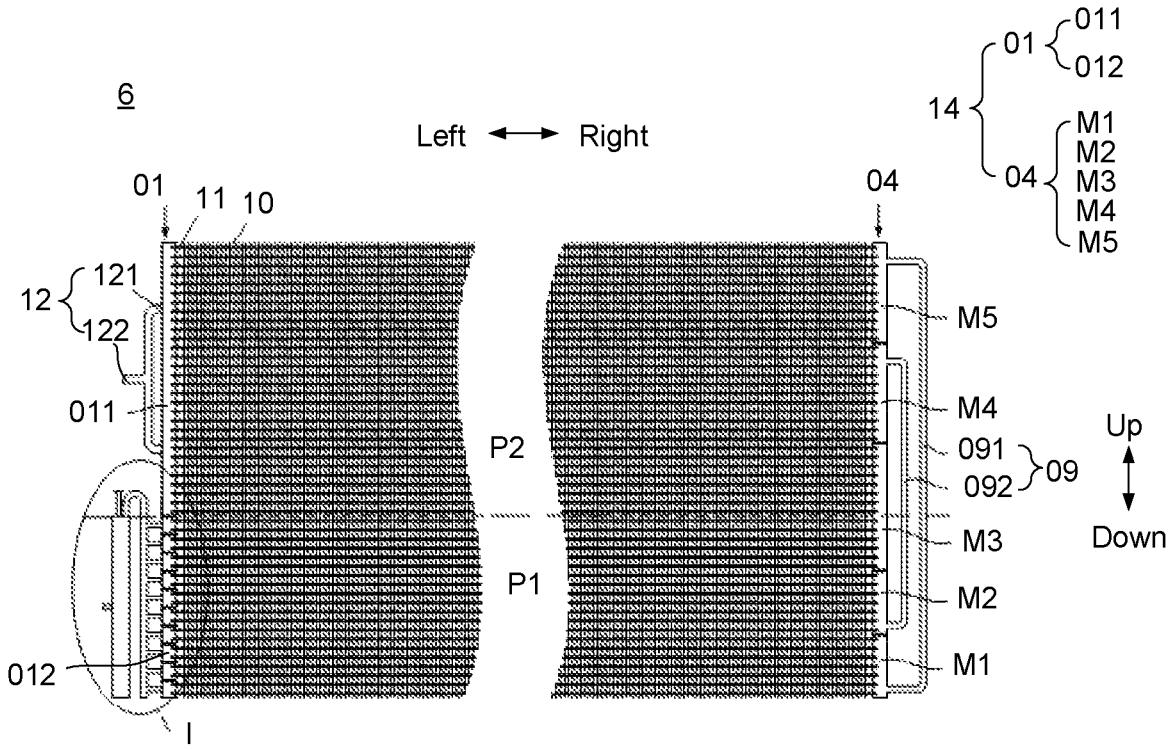
FIG. 3 is a diagram showing a structure of a heat exchanger, in accordance with some embodiments.

FIG. 3 is a diagram showing a structure of a heat exchanger, in accordance with some embodiments. As shown in FIG. 3, the heat exchanger 6 includes a plurality of flat tubes 11 and a plurality of fins 10. The plurality of flat tubes 11 are arranged at equal distances, and the plurality of fins 10 are arranged equal distances.

Each flat tube 11 is provided with a plurality of microchannels, and the microchannels are configured to circulate the gas-liquid two-phase refrigerant. Each fin 10 is disposed between two adjacent flat tubes 11, and a plurality of fins 10 are arranged at equal distances along an extension direction of the two adjacent flat tubes 11. The flow direction of the air flowing through the fins 10 is perpendicular to the flow direction of the gas-liquid two-phase refrigerant flowing through the flat tubes 11, and the heat or cold released by the gas-liquid two-phase refrigerant in the flat tubes 11 is taken away through the fins 10 and the air flow.

A material of the flat tube 11 may be an aluminum alloy. A material of the fin 10 may be an aluminum alloy with a brazing composite layer on a surface thereof—which is light in weight and high in heat exchange efficiency.

In some embodiments, as shown in FIG. 3, the heat exchanger 6 has a first flow path P1 and a second flow path P2, and the flow directions of the gas-liquid two-phase refrigerant in the first flow path P1 and the second flow path P2 are opposite. In a case where the heat exchanger 6 is used as the evaporator 1, the flow direction of the gas-liquid two-phase refrigerant in the flat tube 11 located in the first flow path P1 is a first direction (referring to the direction from left to right in FIG. 3), and the flow direction of the gas-liquid two-phase refrigerant in the flat tube 11 located in the second flow path P2 is a second direction (referring to the direction from right to left in FIG. 3).

The heat exchanger 6 further includes a header assembly 14. The header assembly 14 communicates with the flat tubes 11. The header assembly 14 is configured to collect the gas-liquid two-phase refrigerant and transport the gas-liquid two-phase refrigerant to the flat tubes 11. The header assembly 14 includes a first header 01. The first header 01 is arranged at an end of the heat exchanger 6 and communicates with an end of the flat tubes 11. The first header 01 includes a first chamber 011 and a second chamber 012. The first chamber 011 and the second chamber 012 are arranged in the first header 01. The first chamber 011 and the second chamber 012 are configured to circulate the gas-liquid two-phase refrigerant. The first chamber 011 communicates with the flat tubes 11 in the second flow path P2, and the second chamber 012 communicates with the flat tubes 11 in the first flow path P1.

Figure 4:
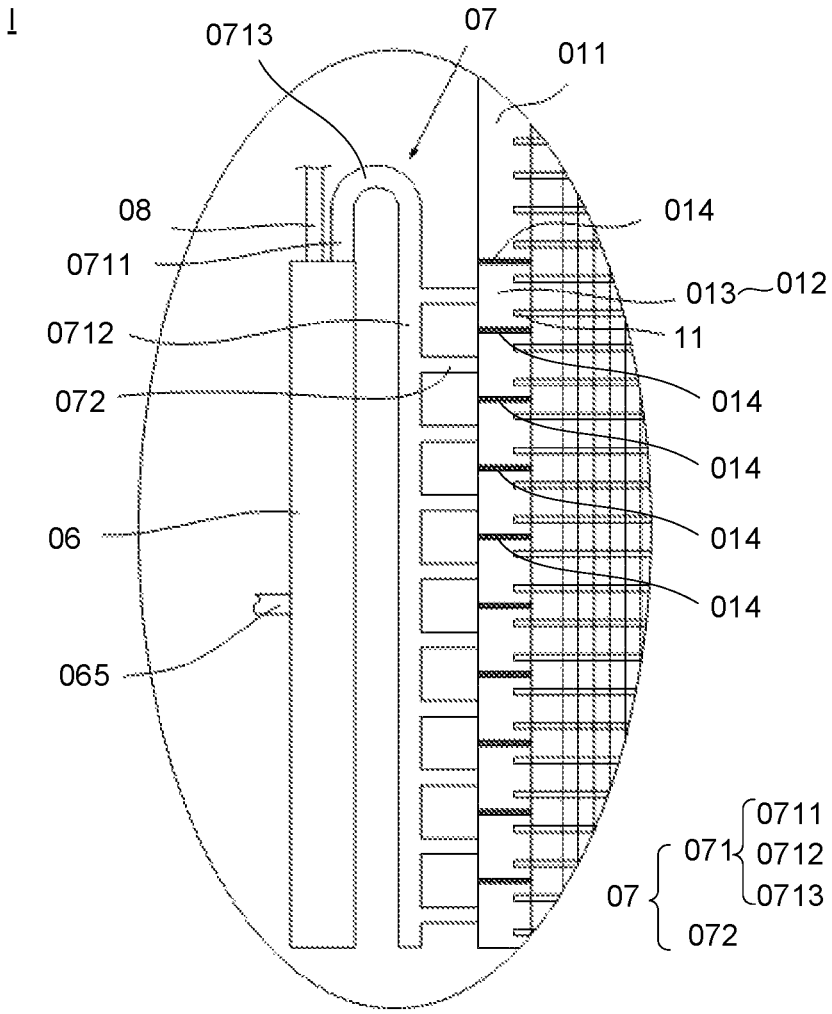
FIG. 4 is a partial enlarged view of the circle I in FIG. 3.

FIG. 4 is a partial enlarged view of the circle I in FIG. 3. As shown in FIG. 4, the heat exchanger 6 further includes a separator 06, a gas distribution pipe group 07 and a liquid distribution pipe group 08.

The separator 06 is configured to separate the gas-phase refrigerant and the liquid-phase refrigerant.

The gas distribution pipe group 07 communicates with the separator 06 and the second chamber 012 and is configured to circulate the gas-phase refrigerant.

The liquid distribution pipe group 08 communicates with the separator 06 and the second chamber 012, and is configured to circulate the liquid-phase refrigerant.

In a case where the heat exchanger 6 is used as the evaporator 1, the gas-liquid two-phase refrigerant is separated by the separator 06 before entering the second chamber 012. The gas-phase refrigerant enters the second chamber 012 through the gas distribution pipe group 07, and the liquid-phase refrigerant enters the second chamber 012 through the liquid distribution pipe group 08.

Figure 5:
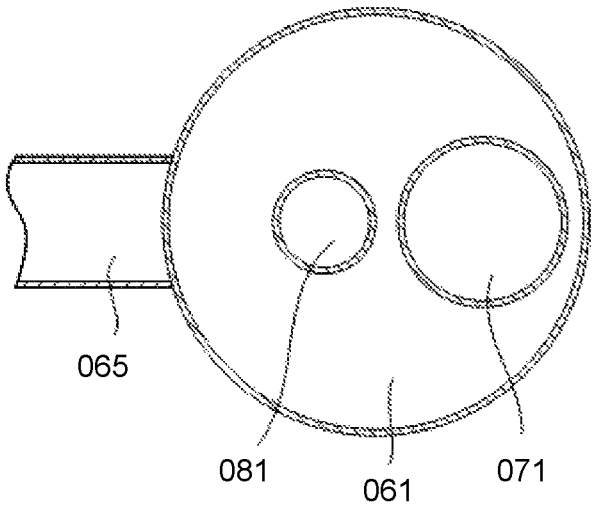
FIG. 5 is a top sectional view of a separator, in accordance with some embodiments.
Figure 6:
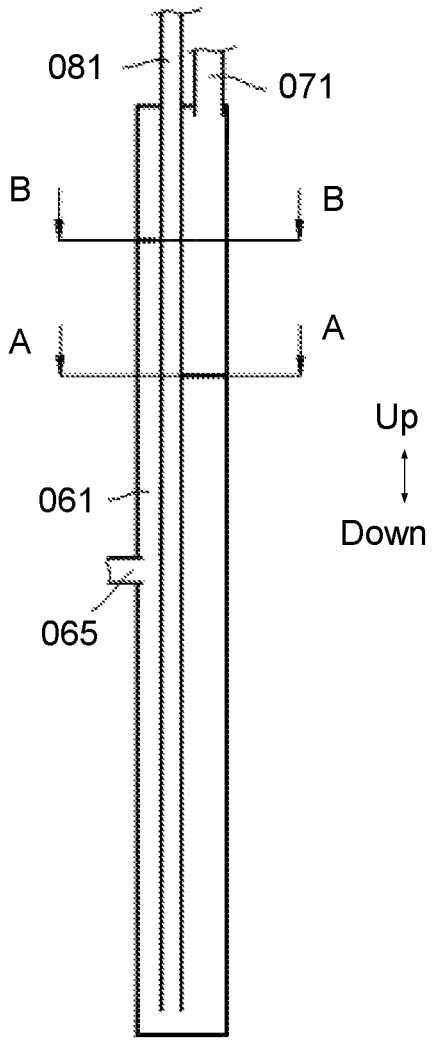
FIG. 6 is a diagram showing an internal structure of a separator, in accordance with some embodiments.

FIG. 5 is a top sectional view of a separator, in accordance with some embodiments. FIG. 6 is a diagram showing an internal structure of a separator, in accordance with some embodiments.

Referring to FIGS. 5 and 6, the separator 06 includes a separator cavity 061 and a refrigerant flow port 065. The separator cavity 061 is disposed inside the separator 06, and the refrigerant flow port 065 is disposed on a side wall of the separator 06. The refrigerant flow port 065 communicates with the separator cavity 061, and the gas-liquid two-phase refrigerant flows into the separator cavity 061 through the refrigerant flow port 065.

The gas distribution pipe group 07 includes a gas distribution main pipe 071 and a plurality of gas distribution branch pipes 072 communicated with the gas distribution main pipe 071 (referring to FIG. 4).

As shown in FIG. 6, the gas distribution main pipe 071 extends into the separator cavity 061. The gas-phase refrigerant in the separator cavity 061 flows out of the gas distribution main pipe 071. Referring to FIG. 4, the gas distribution main pipe 071 includes a first sub-gas distribution main pipe 0711 and a second sub-gas distribution main pipe 0712 communicated with each other.

The gas distribution pipe group 07 further includes a first arc portion 0713. The first sub-gas distribution main pipe 0711 communicates with the separator cavity 061. The first sub-gas distribution main pipe 0711 extends upward from the separator cavity 061 for a certain distance, and then communicates with the second sub-gas distribution main pipe 0712 through the first arc portion 0713. In the separator cavity 061, the gas-phase refrigerant tends to flow toward an upper portion of the separator cavity 061. Referring to FIG. 6, an end (e.g., the lower end) of the first sub-gas distribution main pipe 0711 is disposed at a top of the separator cavity 61, so as to facilitate an inflow of the gas-phase refrigerant from the upper portion of the separator cavity 061.

The second sub-gas distribution main pipe 0712 extends downward, and the second sub-gas distribution main pipe 0712 communicates with the plurality of gas distribution branch pipes 072.

As shown in FIG. 4, each gas distribution branch pipe 072 extends in a horizontal direction and communicates with the second chamber 012. The plurality of gas distribution branch pipes 072 are arranged at equal distances along a height direction of the second sub-gas distribution main pipe 0712. The gas-phase refrigerant is branched along the second sub-gas distribution main pipe 0712 from top to bottom and enters the plurality of gas distribution branch pipes 072, and then enters the second chamber 012 through the plurality of gas distribution branch pipes 072, so that the flow rate of the gas-phase refrigerant in each position of the second chamber 012 is uniform.

Figure 7:
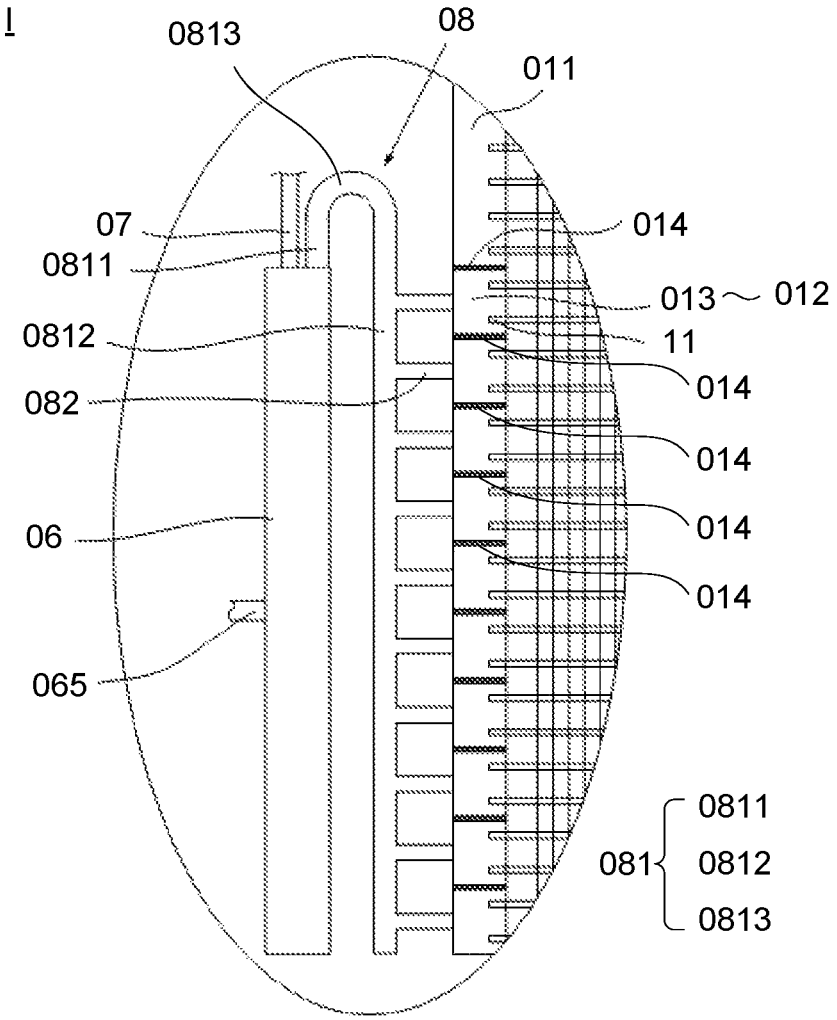
FIG. 7 is another partial enlarged view of a heat exchanger at the circle I, in accordance with some embodiments.

FIG. 7 is another partial enlarged view of a heat exchanger at the circle I, in accordance with some embodiments.

It will be noted that, positions of the gas distribution main pipe 07 and the liquid distribution main pipe 08 in FIG. 4 and FIG. 7 are interchanged, and a positional relationship between the gas distribution main pipe 07 and the liquid distribution main pipe 08 in the present disclosure is not limited thereto.

As shown in FIG. 7, the liquid distribution pipe group 08 includes a liquid distribution main pipe 081 and a plurality of liquid distribution branch pipes 082 communicated with the liquid distribution main pipe 081.

The liquid distribution main pipe 081 extends into the separator cavity 061. The liquid-phase refrigerant in the separator cavity 061 flows out of the liquid distribution main pipe 081. Referring to FIG. 7, the liquid distribution main pipe 081 includes a first sub-liquid distribution main pipe 0811 and a second sub-liquid distribution main pipe 0812 communicated with each other.

The liquid distribution main pipe 081 further includes a second arc portion 0813. The first sub-liquid distribution main pipe 0811 communicates with the separator cavity 061. The first sub-liquid distribution main pipe 0811 extends upward from the separator cavity 061 for a certain distance, and then communicates with the second sub-liquid distribution main pipe 0812 through the second arc portion 0813. In the separator cavity 061, the liquid-phase refrigerant tends to flow toward a bottom of the separator cavity 061. Referring to FIG. 7, an end (e.g., the lower end) of the first sub-liquid distribution main pipe 0811 is arranged at the bottom of the separator cavity 061, and the end of the first sub-liquid distribution main pipe 0811 and the bottom of the separator cavity 061 are spaced with a predetermined distance, so as to facilitate an inflow of the liquid-phase refrigerant from the bottom of the separator cavity 061.

The second sub-liquid distribution main pipe 0812 extends downward, and the second sub-liquid distribution main pipe 0812 communicates with the plurality of liquid distribution branch pipes 082.

As shown in FIG. 7, each liquid distribution branch pipe 082 extends in the horizontal direction and communicates with the second chamber 012. The plurality of liquid distribution branch pipes 082 are arranged at equal distances along a height direction of the second sub-liquid distribution main pipe 0812. The liquid-phase refrigerant is branched along the second sub-liquid distribution main pipe 0812 from top to bottom and enters the plurality of liquid distribution branch pipes 082, and then enters the second chamber 012 through the plurality of liquid distribution branch pipes 082, so that the flow rate of the liquid-phase refrigerant in each position of the second chamber 012 is uniform.

Herein, as for the height direction of the second sub-liquid distribution main pipe 0812, reference may be made to the up-down direction in FIG. 3.

The gas-phase refrigerant and liquid-phase refrigerant separated by the gas distribution pipe group 07 and the liquid distribution pipe group 08 enter the second chamber 012 from top to bottom, and then are branched into respective flat tubes 11 communicated with the second chamber 012. Compared with a bottom-top distribution manner, this solution may suppress an effect of gravity and a resulting gas-liquid separation phenomenon during an upward flow distribution process of the gas-liquid two-phase refrigerant, and an interaction and separation of the gas-liquid two-phase refrigerant during a flow process may be avoided, so that the mass and flow rate of the gas-phase refrigerant and the liquid-phase refrigerant entering the second chamber 012 are approximately equal, and there is no gas-liquid separation phenomenon in the gas-liquid two phase refrigerant in the second chamber 012, which is conducive to improving the distribution uniformity of the gas-liquid two-phase refrigerant in the flat tubes 11.

Figure 8:
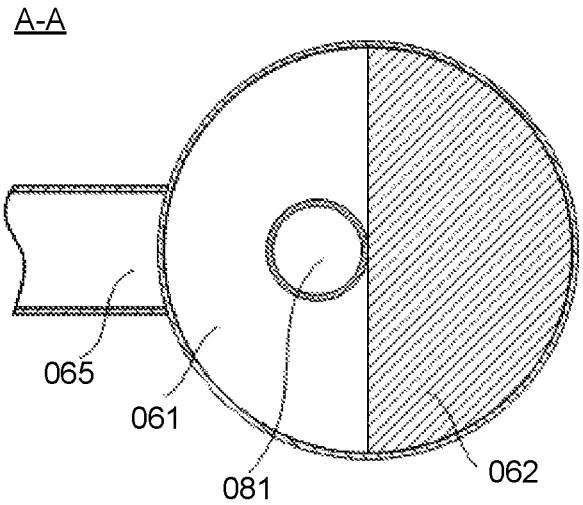
FIG. 8 is a cross-sectional view taken along the line A-A in FIG. 6.

FIG. 8 is a cross-sectional view taken along the line A-A in FIG. 6.

Referring to FIGS. 6 and 8, the separator 06 further includes a first baffle 062. The first baffle 062 is disposed in the separator cavity 061. The first baffle 062 is located below the end of the first sub-gas distribution main pipe 0711 and the first baffle 062 and the end of the first sub-gas distribution main pipe 0711 are spaced with a predetermined distance. The first baffle 062 may improve a separation efficiency of the gas-liquid two-phase refrigerant in the upward flow path, and may prevent the liquid-phase refrigerant from entering the first sub-gas distribution main pipe 0711 due to inertia.

In some embodiments, a thickness direction of the first baffle 062 is substantially parallel to an upward direction of the gas-liquid two-phase refrigerant. As for the upward direction, reference may be made to the direction from bottom to top in FIG. 3.

Figure 9:
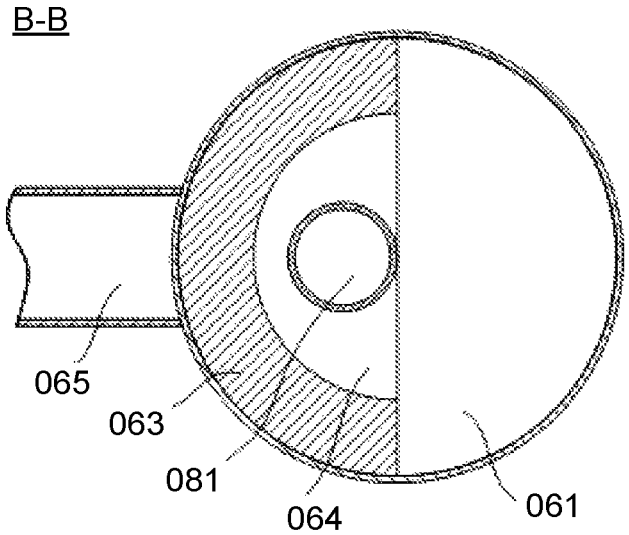
FIG. 9 is a cross-sectional view taken along the line B-B in FIG. 6.

FIG. 9 is a cross-sectional view taken along the line B-B in FIG. 6.

In order to further improve the separation efficiency of the gas-liquid two-phase refrigerant, referring to FIGS. 6 and 9, the separator 06 further includes a second baffle 063. The second baffle 063 is disposed in the separator cavity 061. The first baffle 062 and the second baffle 063 are disposed on two sides of the liquid distribution main pipe 081 (e.g., two sides in the radial direction of the liquid distribution main pipe 081). There is a gap 064 between the second baffle 063 and the liquid distribution main pipe 081, and the gas-phase refrigerant continues to flow upward through the gap 064.

In some embodiments, a thickness direction of the second baffle 063 is substantially parallel to the upward direction of the gas-liquid two-phase refrigerant. In the height direction of the liquid distribution main pipe 081, the second baffle 063 is higher than the first baffle 062 (i.e., the second baffle 063 is closer to the top portion of the separator cavity 061 than the first baffle 062).

Referring to FIG. 4, the first header 01 includes a plurality of first partitions 014. The plurality of first partitions 014 are arranged at equal intervals in the second chamber 012, so as to divide the second chamber 012 into a plurality of sub-chambers 013. Each sub-chamber 013 communicates with a predetermined number of flat tubes 11, and each sub-chamber 013 communicates with the gas distribution branch pipe 072 and the liquid distribution branch pipe 082. In some embodiments, each sub-chamber 013 communicates with the same number of flat tubes 11. In this way, a flow rate of the gas-liquid two-phase refrigerant entering each sub-chamber 013 is uniform. Then, the gas-liquid two-phase refrigerant with the same flow rate is evenly distributed into the same number of flat tubes 11, so as to achieve a uniform flow rate of the gas-liquid two-phase refrigerant in each flat tube 11, and ensure that a pressure loss along a flow path and a local pressure loss of the gas-liquid two-phase refrigerant from entering the first header 01 to leaving the first header 01 are equal.

For example, ten sub-chambers 013 may be provided in the second chamber 012, and each sub-chamber 013 communicates with two flat tubes 11. Of course, in some embodiments, the number of sub-chambers 013 disposed in the second chamber 012 and the number of flat tubes 11 communicated with each sub-chamber 013 may be adaptively arranged as required, and the present disclosure is not limited thereto.

In some embodiments, as shown in FIG. 3, the header assembly 14 further includes a fourth header 04. The fourth header 04 is disposed at an end of the heat exchanger 6 away from the first header 01 and communicates with an end of the flat tubes 11 away from the first header 01.

The fourth header 04 is provided therein with a first sub-chamber M1, a second sub-chamber M2, a third sub-chamber M3, a fourth sub-chamber M4 and a fifth sub-chamber M5 that are mutually independent.

The heat exchanger 6 further includes a connecting pipe 09. The connecting pipe 09 includes a first sub-connecting pipe 091 and a second sub-connecting pipe 092. The first sub-chamber M1 and the fifth sub-chamber M5 are communicated through the first sub-connecting pipe 091. The second sub-chamber M2 and the fourth sub-chamber M4 are communicated through the second sub-connecting pipe 092.

The gas-liquid two-phase refrigerant flowing into the first sub-chamber M1 enters the fifth sub-chamber M5 through the first sub-connecting pipe 091, and the gas-liquid two-phase refrigerant flowing into the second sub-chamber M2 enters the fourth sub-chamber M4 through the second sub-connecting pipe 092. The gas-liquid two-phase refrigerant in a part of flat tubes 11 of the first flow path P1 enters the third sub-chamber M3 and then flows upward and enters a part of flat tubes 11 in the second flow path P2. In this way, by providing mutually independent sub-chambers inside the fourth header 04, it is ensured that a pressure loss along a flow path and a local pressure loss of the gas-liquid two-phase refrigerant from entering the fourth header 04 to leaving the fourth header 04 are equal, and there is a good flow distribution uniformity of the entire heat exchanger 6.

In some embodiments, in a case where the gas-liquid two-phase refrigerant evaporates and exchanges heat in the flat tubes 11, a specific volume and a flow velocity increase, and a degree of gas-liquid mixing increases. Therefore, the number of flat tubes in a flow direction of the gas-liquid two-phase refrigerant should be increased. For example, as shown in FIG. 3, in the first flow path P1, the flow direction of the gas-liquid two-phase refrigerant is a direction from left to right. In the second flow path P2, the flow direction of the gas-liquid two-phase refrigerant is a direction from right to left. On the contrary, in a case where the gas-liquid two-phase refrigerant condenses and exchanges heat in the flat tubes 11, the specific volume and flow velocity decrease, and the gas-liquid tends to separate. Therefore, the number of flat tubes 11 in the flow direction of the gas-liquid two-phase refrigerant should be reduced.

For example, in a case where the heat exchanger 6 is used as an evaporator, the number of flat tubes 11 communicating with the first sub-chamber M1 is less than the number of flat tubes 11 communicating with the fifth sub-chamber M5, the number of flat tubes 11 communicating with the second sub-chamber M2 is less than the number of flat tubes 11 communicating with the fourth sub-chamber M4, and the number of the flat tubes 11 where the gas-liquid two-phase refrigerant flows into the third sub-chamber M3 is less than the number of the flat tubes 11 where the gas-liquid two-phase refrigerant flows out of the third sub-chamber M3.

In some embodiments, an end of the first sub-connecting pipe 091 communicates to a lower end of the first sub-chamber M1, so that the liquid-phase refrigerant in a lower portion of the first sub-chamber M1 flows into the first sub-connecting pipe 091. Another end of the first sub-connecting pipe 091 communicates to an upper end of the fifth sub-chamber M5. In this way, the gas-liquid two-phase refrigerant in the first sub-connecting pipe 091 flows into the fifth sub-chamber M5 from top to bottom, so that a flow rate uniformity of the gas-liquid two-phase refrigerant in the flat tubes 11 communicating with the fifth sub-chamber M5 is improved through gravity.

Similarly, an end of the second sub-connecting pipe 092 communicates to a lower end of the second sub-chamber M2, so that the liquid-phase refrigerant in a lower portion of the second sub-chamber M2 flows into the second sub-connecting pipe 092. Another end of the second sub-connecting pipe 092 communicates to an upper end of the fourth sub-chamber M4. In this way, the gas-liquid two-phase refrigerant in the second sub-connecting pipe 092 flows into the fourth sub-chamber M4 from top to bottom, so that a flow rate uniformity of the gas-liquid two-phase refrigerant in the flat tubes 11 communicating with the fourth sub-chamber M4 is improved through gravity.

Referring to FIG. 3, the heat exchanger 6 further includes a gas pipe group 12, and the gas pipe group 12 includes a main gas pipe 122 and a plurality of gas pipe branches 121 communicating with the main gas pipe 122. The plurality of gas pipe branches 121 communicate with the first chamber 011. The gas-liquid two-phase refrigerant in the first chamber 011 flows into the main gas pipe 122 through the plurality of gas pipe branches 121 first, and then flows out after being collected by the main gas pipe 122.

In a case where the heat exchanger 6 is used as an evaporator, the flow path of the gas-liquid two-phase refrigerant is as follows.

The gas-liquid two-phase refrigerant enters the separator 06 from the refrigerant flow port 065. The gas-phase refrigerant enters the second chamber 012 of the first header 01 through the gas distribution pipe group 07, and the liquid-phase refrigerant enters the second chamber 012 of the first header 01 through the liquid distribution pipe group 08. Then, the gas-phase refrigerant and the liquid-phase refrigerant enters the plurality of flat tubes 11 in the first flow path P1, then passes through the first sub-connecting pipe 091, the second sub-connecting pipe 092, and the fourth header 04 to enter the plurality of flat tubes 11 in the second flow path P2, and finally flows out from the gas pipe group 12 through the first chamber 011 of the first header 01.

In a case where the heat exchanger 6 is used as a condenser, the flow direction of the gas-liquid two-phase refrigerant in the heat exchanger 6 is opposite to that in the case where the heat exchanger 6 is used as an evaporator, and details will not be repeated herein.

Figure 10:
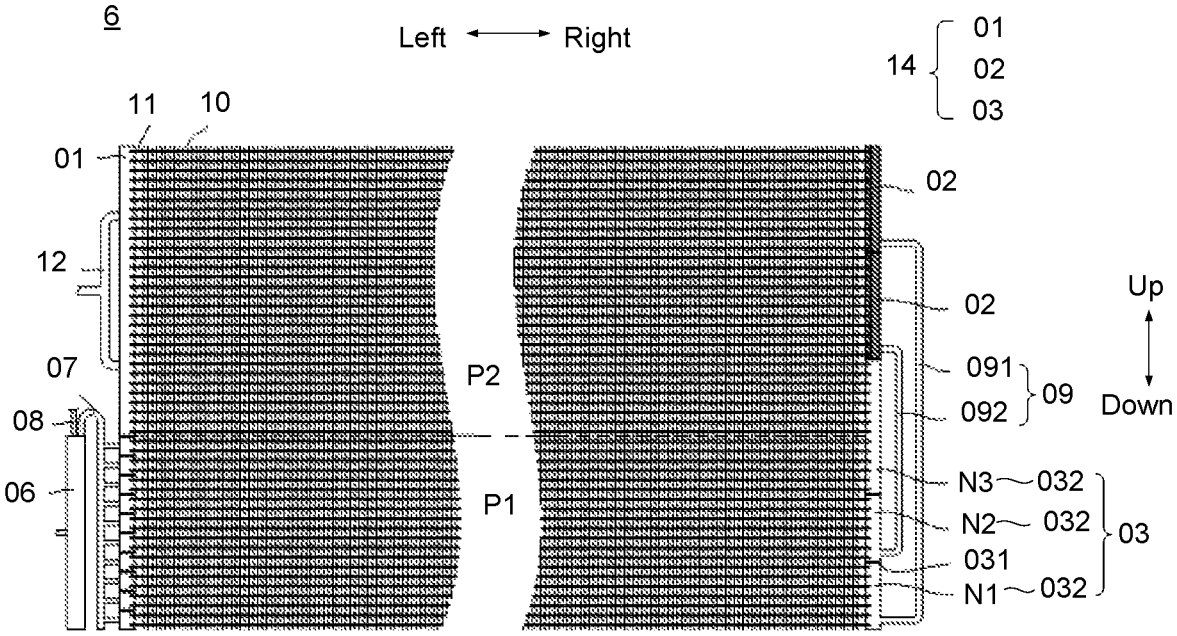
FIG. 10 is a diagram showing a structure of another heat exchanger, in accordance with some embodiments.

FIG. 10 is a diagram showing a structure of another heat exchanger, in accordance with some embodiments.

In some embodiments, as shown in FIG. 10, the header assembly 14 further includes a second header 02 and a third header 03. Flat tubes 11 in the first flow path P1 and flat tubes 11 in the second flow path P2 are communicated with each other through the second header 02 and the third header 03. The second header 02 communicates with a part of flat tubes 11 in the second flow path P2, and the third header 03 communicates with the flat tubes 11 in the first flow path P1 and another part of flat tubes 11 in the second flow path P2. The second header 02 and the third header 03 are communicated with each other through a connecting pipe 09.

Figure 11:
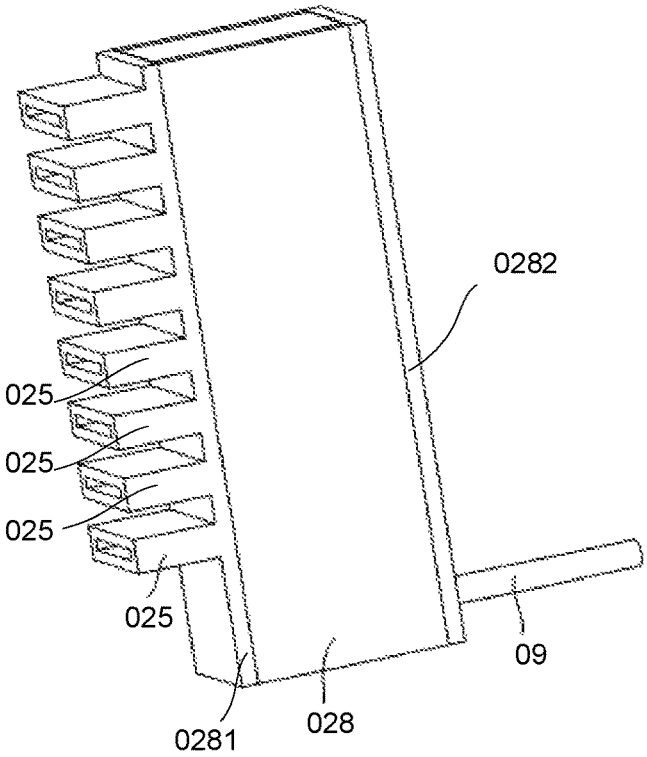
FIG. 11 is a diagram showing a structure of a second header, in accordance with some embodiments.
Figure 12:
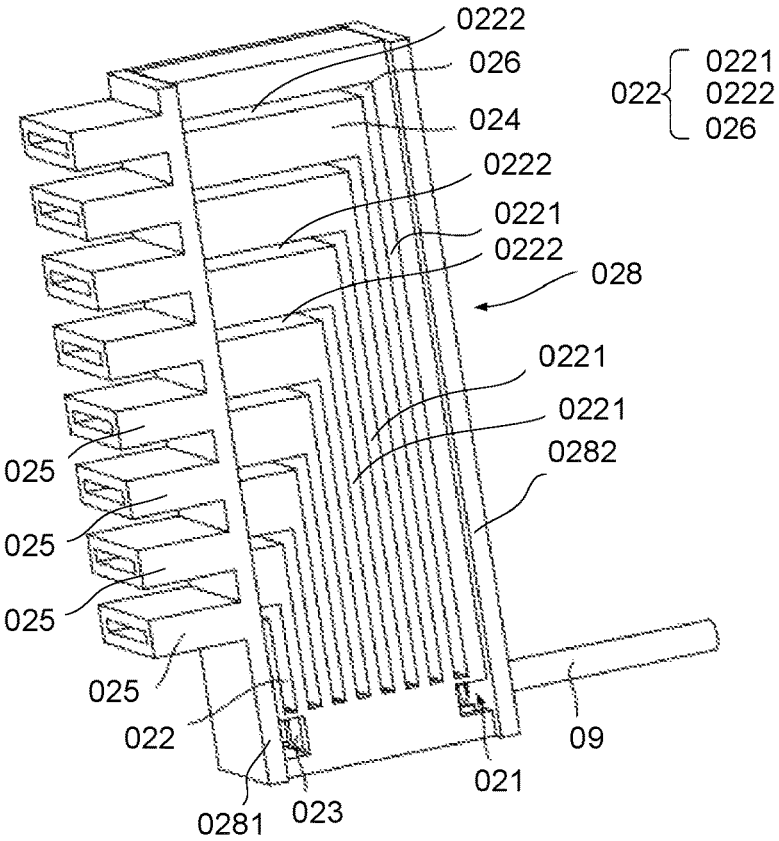
FIG. 12 is diagram showing a structure of the second header in FIG. 11 with a side wall removed.

FIG. 11 is a diagram showing a structure of a second header, in accordance with some embodiments. FIG. 12 is diagram showing a structure of the second header in FIG. 11 with a side wall removed.

Referring to FIGS. 11 and 12, the second header 02 includes a cavity 021, a channel 022 and a flow disturbing portion 023. The second header 02 further includes an inlet 027 of the refrigerant (referring to FIG. 16). The cavity 021 communicates with the connecting pipe 09. An end of the channel 022 proximate to an inlet 027 of the gas-liquid two-phase refrigerant communicates with the cavity 021, and another end of the channel 022 away from the inlet 027 of the gas-liquid two-phase refrigerant communicates with the part of flat tubes 11 in the second flow path P2. The flow disturbing portion 023 is disposed in the cavity 021 and is configured to disturb a flow of the gas-liquid two-phase refrigerant in the cavity 021, so as to facilitate mixing of the gas-liquid two-phase refrigerant in a high pressure region and a low pressure region in the cavity 021.

The gas-liquid two-phase refrigerant in the flat tubes 11 of the first flow path P1 enters the second header 02 through the third header 03 and the connecting pipe 09. When the gas-liquid two-phase refrigerant enters the second header 02, the gas-liquid two-phase refrigerant enters the cavity 021 first. Since the greater the flow rate of the gas-liquid two-phase refrigerant, the more uneven the distribution of the gas-liquid two-phase refrigerant, a low pressure will be generated at an inflow end of the gas-liquid two-phase refrigerant, and then the high pressure region and the low pressure region will be formed in the cavity 021. The flow disturbing portion 023 may effectively prevent an eddy current from forming a flow blind region in the cavity 021. The flow disturbing portion 023 disturbs the flow of the gas-liquid two-phase refrigerant in the cavity 021, which facilitates mixing of the gas-liquid two-phase refrigerant in the high pressure region and the low pressure region in the cavity 021. The gas-liquid two-phase refrigerant circulates in the cavity 021, and a path for circulating the gas-liquid two-phase refrigerant which is formed by the flow disturbing portion 023 may automatically adapt to changes in the flow rate of the gas-liquid two-phase refrigerant, so that the gas-liquid two-phase refrigerant entering different channels 022 may be evenly distributed, so that a uniform flow rate of the gas-liquid two-phase refrigerant in different flat tubes 11 in a same flow path and in different microchannels in a same flat tube 11 is achieved.

Referring to FIGS. 11 and 12, the second header 02 includes a header body 028. The header body 028 is provided with the cavity 021, the channel 022 and the flow disturbing portion 023. The second header 02 further includes a plurality of inner walls 024, an interior space of the header body 028 provides a plurality of channels 022 through the plurality of inner walls 024 that are spaced apart, and the plurality of channels 022 are evenly spaced. The cavity 021 is formed at a bottom of the header body 028, the plurality of flat tubes 11 are connected to a side wall 0281 of the header body 028, and the connecting pipe 09 is connected to another side wall 0282 of the header body 028 opposite to the flat tubes 11.

It will be noted that, in FIG. 12, in order to facilitate the illustration of an internal structure of the second header 02, a side wall of the second header 02 has been removed.

In FIGS. 11 and 12, the header body 028 is in a shape of a cube, and the channels 022 formed by the plurality of inner walls 24 are of a flat structure. Since the channel 022 is of a flat structure that matches a structure of the flat tube 11, which is conducive to distributing the gas-liquid two-phase refrigerant evenly in the channel 022, and also conducive to improving the distribution uniformity of the gas-liquid two-phase refrigerant entering different microchannels of the same flat tube 11.

Of course, in some embodiments, the second header 02 may also be of a cylindrical structure or an elliptical cylindrical structure, and the present disclosure is not limited thereto.

The plurality of channels 022 are evenly spaced, so that the gas-liquid two-phase refrigerant in the cavity 021 may flow into different channels 022 evenly, so as to improve the uniformity of the flow rate of the gas-liquid two-phase refrigerant in the flat tubes 11 communicating with each channel 022.

In some embodiments, as shown in FIG. 12, the channel 022 includes a vertical sub-channel 0221, a horizontal sub-channel 0222 and a bending sub-channel 026. The vertical sub-channel 0221 and the horizontal sub-channel 0222 are connected with each other through the bending sub-channel 026. For example, an end of the vertical sub-channel 0221 is disposed proximate to the cavity 021, another end of the vertical sub-channel 0221 communicates with an end of the horizontal sub-channel 0222 through the bending sub-channel 026, and another end of the horizontal sub-channel 0222 communicates with the flat tube 11. The vertical sub-channel 0221 of the channel 022 is perpendicular to the cavity 021, and the horizontal sub-channel 0222 of the channel 022 is parallel to the flat tube 11, so that the gas-liquid two-phase refrigerant may circulate between the cavity 021 and the channel 022, and between the flat tube 11 and the channel 022.

In some embodiments, the channel 022 may also be a flow channel of other structural manners, for example, a flow channel with a circular arc surface. In order to balance a resistance between different channels 022, the number of windings of the channel 022 and the surface roughness of the channel 022 may be changed.

It will be noted that, as for the number of windings of the channel 022, reference may be made to the number of windings of changing the flow direction of the gas-liquid two-phase refrigerant in the channel 022.

The second header 02 further includes an insertion portion 025. The insertion portion 025 is disposed on the side wall 0281 of the header body 028. The insertion portion 025 communicates with the channel 022, and the flat tube 11 is inserted into the insertion portion 025, so as to achieve communication between the flat tube 11 and the channel 022.

Figure 13:
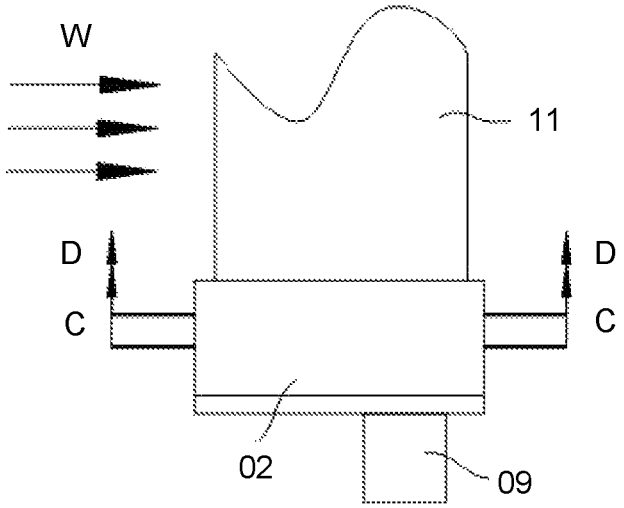
FIG. 13 is a top view of a second header, in accordance with some embodiments.
Figure 14:
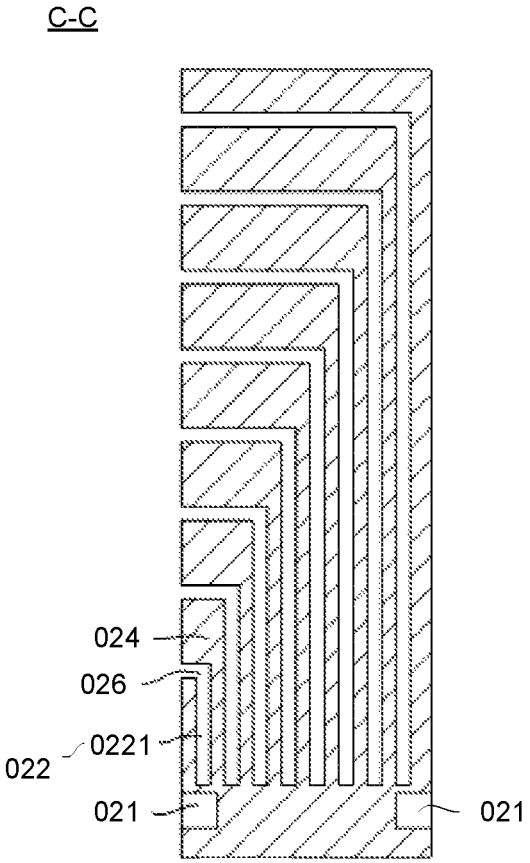
FIG. 14 is a cross-sectional view taken along the line C-C in FIG. 13.
Figure 15:
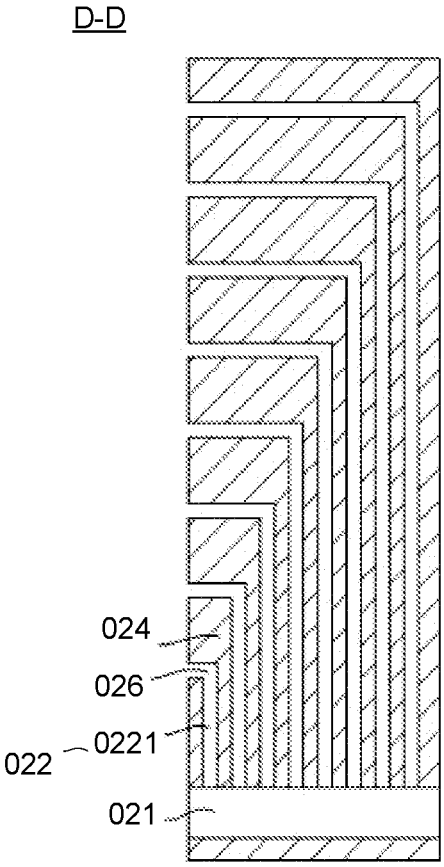
FIG. 15 is a cross-sectional view taken along the line D-D in FIG. 13.
Figure 16:
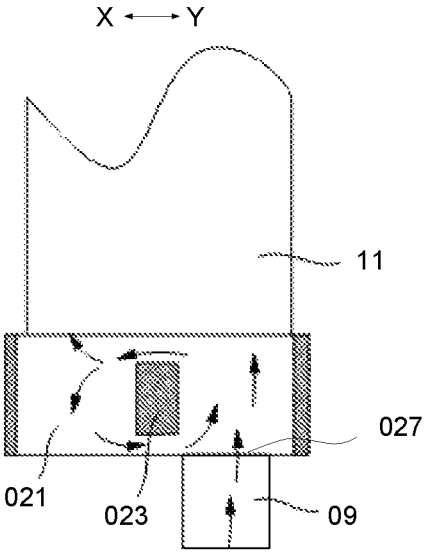
FIG. 16 is a schematic diagram showing a structure of a second header (the arrows showing a flow direction of a gas-liquid two-phase refrigerant), in accordance with some embodiments.

FIG. 13 is a top view of a second header, in accordance with some embodiments. FIG. 14 is a cross-sectional view taken along the line C-C in FIG. 13. FIG. 15 is a cross-sectional view taken along the line D-D in FIG. 13. FIG. 16 is a schematic diagram showing a structure of a second header (the arrows showing a flow direction of a gas-liquid two-phase refrigerant), in accordance with some embodiments.

In some embodiments, the flow disturbing portion 023 extends in a direction parallel to an inflow direction of the gas-liquid two-phase refrigerant. As shown in FIG. 16, in a case where the second header 02 includes one flow disturbing portion 023, there is a gap between the flow disturbing portion 023 and each of surrounding inner walls of the cavity 021.

Arrows in FIG. 16 show the flow direction of the gas-liquid two-phase refrigerant. In a case where the gas-liquid two-phase refrigerant evaporates in the heat exchanger 6, after the gas-liquid two-phase refrigerant flows from the connecting pipe 09 into the cavity 021, a part of the gas-liquid two-phase refrigerant flows directly into the channel 022 through the inlet 027 of the refrigerant. Another part of the gas-liquid two-phase refrigerant bypasses the flow disturbing portion 023 and enters a side (i.e., referring to the X side portion of the cavity 021 in FIG. 16) of the cavity 021 away from the inlet 027 of the gas-liquid two-phase refrigerant.

During the process of the another part of the gas-liquid two-phase refrigerant flowing around the flow disturbing portion 023, a part of the gas-liquid two-phase refrigerant in the another part of the gas-liquid two-phase refrigerant will flow into the channel 022, and a remaining part of the another part of the gas-liquid two-phase refrigerant will bypass the flow disturbing portion 023 and then mix with a gas-liquid two-phase refrigerant newly flowing into the cavity 021 to enter a next flow cycle.

Since a flow velocity of the gas-liquid two-phase refrigerant flowing from the connecting pipe 09 into the cavity 021 is relatively high, a pressure at the inlet 027 of the gas-liquid two-phase refrigerant in the cavity 021 is relatively low. As a result, the gas-liquid two-phase refrigerant that fails to flow into the channel 022 in time may flow around the flow disturbing portion 023 and return to the inlet 027 of the refrigerant, so as to achieve circulation flow. In this way, a gas-liquid two-phase refrigerant circulation flow path formed in the cavity 021 may help improve the distribution uniformity of the gas-liquid two-phase refrigerant in the cavity 021, and make the gas-liquid two-phase refrigerant enter different channels 022 evenly, so that the gas-liquid two-phase refrigerant is evenly distributed in different flat tubes 11.

At high flow rate, the distribution of refrigerant is significantly uneven. In a case where the flow rate of the gas-liquid two-phase refrigerant is high, the gas-liquid two-phase refrigerant circulation flow path has a significant effect on improving the distribution uniformity of the gas-liquid two-phase refrigerant. This is because the larger the flow rate, the more significant the low pressure effect caused by an injection at the inlet 027 of the gas-liquid two-phase refrigerant in the cavity 021. As a result, a circulation loop in which the gas-liquid two-phase refrigerant flows around the flow disturbing portion 023 is even more significant. Therefore, the circulation loop of the gas-liquid two-phase refrigerant may automatically adapt to the change of the flow rate of the external gas-liquid two-phase refrigerant, thereby improving the distribution uniformity of the gas-liquid two-phase refrigerant.

In some embodiments, referring to FIGS. 13 and 16, the connecting pipe 09 is disposed at a side of the cavity 021 away from an air supply direction W (e.g., the side away from the flat tubes 11), which is conducive to improving a heat dissipation efficiency.

Figure 17:
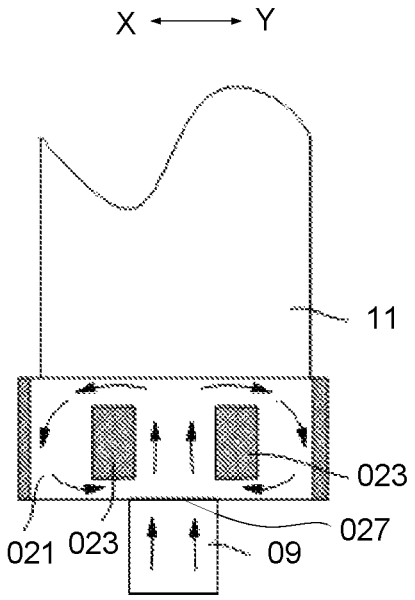
FIG. 17 is a diagram showing a structure of another second header, in accordance with some embodiments.
Figure 18:
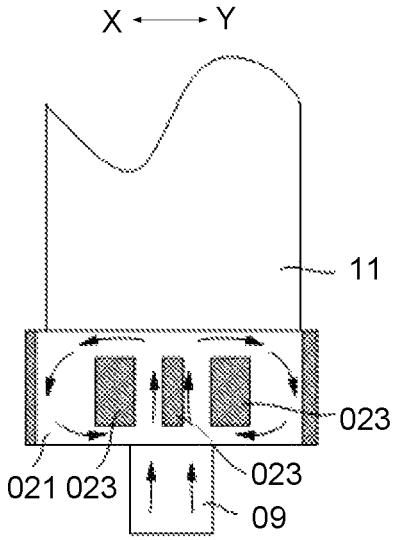
FIG. 18 is diagram showing a structure of yet another second header, in accordance with some embodiments.

FIG. 17 is a diagram showing a structure of another second header, in accordance with some embodiments. FIG. 18 is diagram showing a structure of yet another second header, in accordance with some embodiments.

As shown in FIG. 17 or FIG. 18, in a case where the second header 02 includes a plurality of flow disturbing portions 023, there is a gap between two adjacent flow disturbing portions 023, and there is a gap between each of the flow disturbing portions 023 and each of the surrounding inner walls of the cavity 021. The uniform distribution effect of the gas-liquid two-phase refrigerant may be further improved by increasing the number of the flow disturbing portions 023 to form a plurality of backflows and a plurality of disturbed flows in the cavity 021.

The flow disturbing process of the flow disturbing portions 023 in FIG. 17 is the same as that of the flow disturbing portion 023 in FIG. 16. A difference between FIG. 17 and FIG. 16 is that the second header 02 in FIG. 17 includes two flow disturbing portions 023 (i.e., a first sub-flow disturbing portion and a second sub-flow disturbing portion). The two flow disturbing portions 023 are symmetrically distributed in the cavity 021 with respect to a position where the gas-liquid two-phase refrigerant flows into the cavity 021. The gas-liquid two-phase refrigerant that flows into the cavity 021 first enters a gap between the two flow disturbing portions 023, and then is divided into two paths; one path of the gas-liquid two-phase refrigerant forms a circulation loop around the flow disturbing portion 023 on the X side, and another path of the gas-liquid two-phase refrigerant forms a circulation loop around the flow disturbing portion 023 on the Y side.

The flow disturbing process of the flow disturbing portions 023 in FIG. 18 is the same as the flow disturbing process of the flow disturbing portion 023 in FIG. 16. A difference between FIG. 18 and FIG. 16 is that the second header 02 in FIG. 18 includes three flow disturbing portions 023 (i.e., a first sub-flow disturbing portion, a second sub-flow disturbing portion and a third sub-flow disturbing portion). One of the three flow disturbing portions 023 located in the middle (i.e., the third sub-flow disturbing portion) is directly opposite to the position where the gas-liquid two-phase refrigerant flows into the cavity 021. Two of the flow disturbing portions 023 located on two sides (i.e., the first sub-flow disturbing portion and the second sub-flow disturbing portion) are symmetrically distributed in the cavity 021 with respect to the position where the gas-liquid two-phase refrigerant flows into the cavity 021. The gas-liquid two-phase refrigerant flowing into the cavity 021 is divided into two paths through the middle flow disturbing portion 023 and the gap between the two flow disturbing portions 023 on the two sides, and one path flows along a gap between the flow disturbing portion 023 on the X side and the flow disturbing portion 023 in the middle, and forms a circulation loop around the flow disturbing portion 023 on the X side. Another path flows along a gap between the flow disturbing portion 023 on the Y side and the flow disturbing portion 023 in the middle, and forms a circulation loop around the flow disturbing portion 023 on the Y side.

In some embodiments, the header assembly 14 includes one second header 02, or the header assembly 14 includes a plurality of second headers 02. The number of flat tubes 11 that may communicate with each second header 02 is in a range of 1 to 20 inclusive. For example, each second header 02 may communicate with 1, 3, 5, 8, 10, 15, 18 or 20 flat tubes 11. The number of flat tubes 11 that can communicate with each second header 02 may be adaptively arranged according to actual needs.

As shown in FIG. 10, the third header 03 includes a plurality of third partitions 031. The plurality of third partitions 031 divide an interior space of the third header 03 into a plurality of independent third chambers 032. One of the third chambers 032 communicates with a part of flat tubes 11 in the first flow path P1 and a part of flat tubes 11 in the second flow path P2, and the number of remaining third chambers 032 is the same as the number of the second headers 02. The remaining third chambers 032 communicate with the corresponding second headers 02 in one-to-one correspondence through the connecting pipe 09.

As shown in FIG. 10, the header assembly 14 includes two second headers 02, the third header 03 includes two third partitions 031, and the two third partitions 031 divide the interior space of the third header 03 into three mutually independent third chambers 032, which are marked as N1, N2, and N3 in sequence from bottom to top. The second header 02 located at an upper portion communicates with the third chamber N1 through the first sub-connecting pipe 091, the second header 02 located at a lower portion communicates with the third chamber N2 through the second sub-connecting pipe 092, and the third chamber N3 communicates with the part of flat tubes 11 in the first flow path P1 and the part of flat tubes 11 in the second flow path P2.

The uniform distribution of the gas-liquid two-phase refrigerant may be further improved through the cooperation of the plurality of third chambers 032 and the plurality of second headers 02.

As shown in FIG. 10, an end of the first sub-connecting pipe 091 communicates with a lower end of the third chamber N1, so that the liquid-phase refrigerant in the third chamber N1 flows into the first sub-connecting pipe 091. Another end of the first sub-connecting pipe 091 communicates with a lower end of the second header 02 and communicates with the cavity 021, so that the gas-liquid two-phase refrigerant may be evenly distributed through the second header 02.

Similarly, an end of the second sub-connecting pipe 092 communicates with a lower end of the third chamber N2, so that the liquid-phase refrigerant in the third chamber N2 flows into the second sub-connecting pipe 092. Another end of the second sub-connecting pipe 092 communicates with a lower end of the second header 02 and communicates with the cavity 021, so that the gas-liquid two-phase refrigerant may be evenly distributed through the second header 02.

In some embodiments, of the third chamber 032 and the second header 02 communicating with two ends of the same connecting pipe 09, the number of flat tubes 11 communicating with the third chamber 032 is less than the number of flat tubes 11 communicating with the second header 02. For example, as shown in FIG. 10, the number of flat tubes 11 communicating with the third chamber N1 is less than the number of flat tubes 11 communicating with the second header 02; the number of flat tubes 11 communicating with the third chamber N2 is less than the number of flat tubes 11 communicating with the second header 02; and the number of flat tubes 11 in the first flow path P1 communicating with the third chamber N3 is less than the number of flat tubes 11 in the second flow path P2 communicating with the third chamber N3. In this way, beneficial effects of such design is similar to that of a design of multi layers of sub-chambers of the fourth header 04, and details will not be repeated herein.

Figure 19:
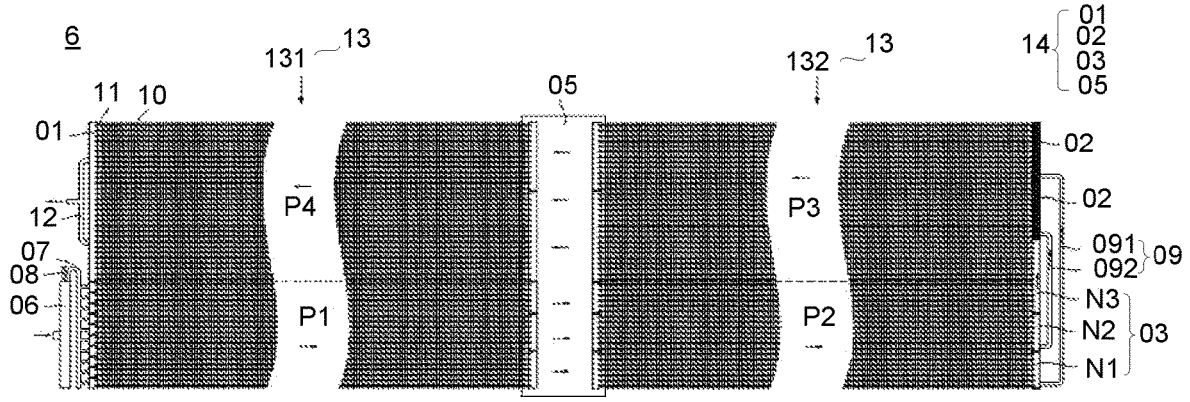
FIG. 19 is a diagram showing a structure of yet another heat exchanger (evaporation mode), in accordance with some embodiments.
Figure 20:
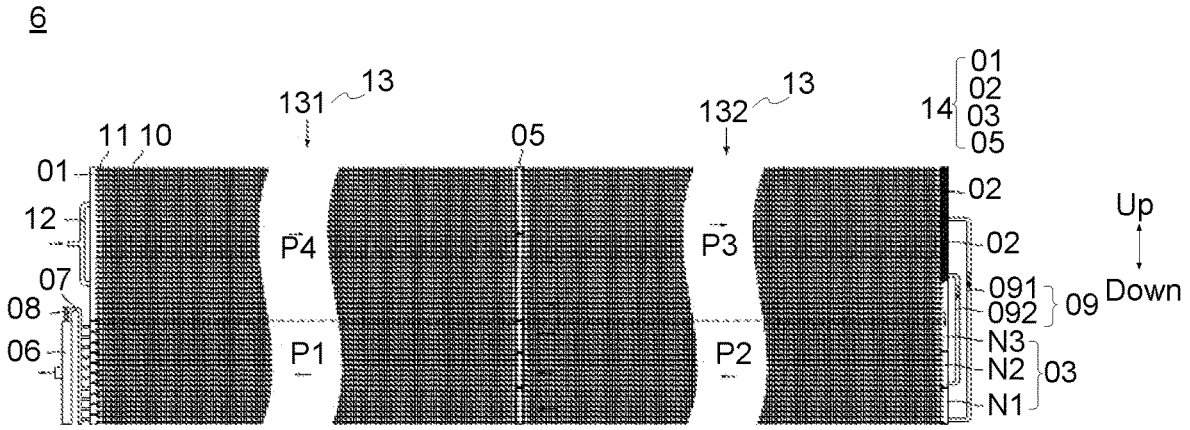
FIG. 20 is a diagram showing a structure of yet another heat exchanger (condensation mode), in accordance with some embodiments.
Figure 21:
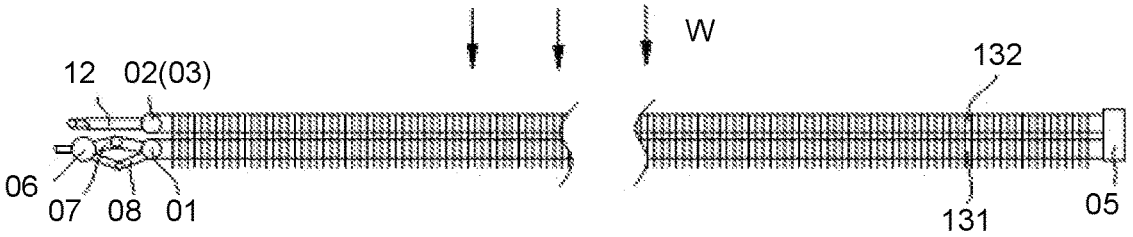
FIG. 21 is a diagram showing a structure of yet another heat exchanger after actual installation, in accordance with some embodiments.

In some embodiments, in order to improve the heat exchange efficiency of the heat exchanger 6, a plurality of heat exchangers 6 may be arranged to be communicated with each other in parallel. FIG. 19 is a diagram showing a structure of yet another heat exchanger (evaporation mode), in accordance with some embodiments. FIG. 20 is a diagram showing a structure of yet another heat exchanger (condensation mode), in accordance with some embodiments. FIG. 21 is a diagram showing a structure of yet another heat exchanger after actual installation, in accordance with some embodiments.

It will be noted that, arrows in FIG. 19 show the flow directions of the gas-liquid two-phase refrigerant in a case where the heat exchanger is in an evaporation mode. Arrows in FIG. 20 show the flow directions of the gas-liquid two-phase refrigeration in a case where the heat exchanger is in a condensation mode.

As shown in FIG. 19, the heat exchanger 6 further includes a plurality of heat exchange portions 13, and the header assembly 14 further includes an intermediate header 05. The plurality of heat exchange portions 13 are arranged to be communicated with each other in parallel. Flat tubes 11 of two adjacent heat exchange portions 13 are communicated with each other through the intermediate header 05.

It will be noted that, by folding the heat exchanger 6 in FIG. 19 or FIG. 20 along the intermediate header 05, the structure of the heat exchanger 6 after the actual installation in FIG. 21 may be obtained.

In some embodiments, as shown in FIG. 20, the heat exchanger 6 includes two heat exchange portions 13, and the two heat exchange parts 13 are defined as a first-row heat exchange portion 131 and a second-row heat exchange portion 132. As shown in FIG. 21, the first-row heat exchange portion 131 is located at a downwind region of the air supply direction W (e.g., a region away from the air supply direction W), and the second-row heat exchange portion 132 is located at an upwind region of the air supply direction W (e.g., a region proximate to the air supply direction W). The first-row heat exchange portion 131 and the second-row heat exchange portion 132 each include the plurality of flat tubes 11 arranged at equal distances and the plurality of fins 10 arranged at equal distances. The air flows through the gaps between the flat tubes 11 and the fins 10 to achieve heat-exchange. The first-row heat exchange portion 131 and the second-row heat exchange portion 132 are communicated with each other through the intermediate header 05. The heat exchanger 6 includes a first flow path P1, a second flow path P2, a third flow path P3 and a fourth flow path P4. The first flow path P1 and the fourth flow path P4 are located in the first-row heat exchange portion 131, and the second flow path P2 and the third flow path P3 are located in the second-row heat exchange portion 132. The flat tubes 11 located in the first flow path P1 and the flat tubes 11 located in the second flow path P2 are communicated with each other through the intermediate header 05. The flat tubes 11 located in the third flow path P3 and the flat tubes 11 located in the fourth flow path P4 are communicated with each other through the intermediate header 05.

As for structures of ends of the first-row heat exchange portion 131 and the second-row heat exchange portion 132 that are away from the intermediate header 05, reference may be made to the structure in a case where the air conditioner 1000 includes one heat exchange portion 13, and details will not be repeated herein.

Referring to FIG. 19, in a case where the heat exchanger 6 is in the evaporation mode, the gas-liquid two-phase refrigerant passes through the separator 06, the gas distribution pipe group 07 and the liquid distribution pipe group 08 and enters the second chamber 012 of the first header 01, then passes through the first flow path P1, the intermediate header 05 and the second flow path P2 in sequence and enters the third header 03, then passes through the first sub-connecting pipe 091 and the second sub-connecting pipe 092 and enters the second header 02, then passes through the third flow path P3, the intermediate header 05 and the fourth flow path P4 and enters the first chamber 011 of the first header 01, and finally flows out from a gas pipe group 12.

Referring to FIG. 20, in a case where the heat exchanger 6 is in the condensation mode, the flow path of the gas-liquid two-phase refrigerant is opposite to that in a case where the heat exchanger 6 is in the evaporation mode, and details will not be repeated herein.

As for the number of flat tubes 11 in each flow path, the number of flat tubes 11 in the first flow path P1, the second flow path P2, the third flow path P3 and the fourth flow path P4 increases. That is, the number of flat tubes 11 in the fourth flow path P4 is greater than the number of flat tubes 11 in the third flow path P3, the number of flat tubes 11 in the third flow path P3 is greater than the number of flat tubes 11 in the second flow path P2, and the number of flat tubes 11 in the second flow path P2 is greater than the number of flat tubes 11 in the first flow path P1.

A plurality of sub-cavities 051 are formed inside the intermediate header 05 through partition plates and the plurality of sub-cavities 051 are arranged along a height direction (the up-down direction in FIG. 20) of the intermediate header 05. The plurality of sub-cavities 051 are mutually independent of each other, and the structure of each sub-cavity 051 is the same.

Figure 22:
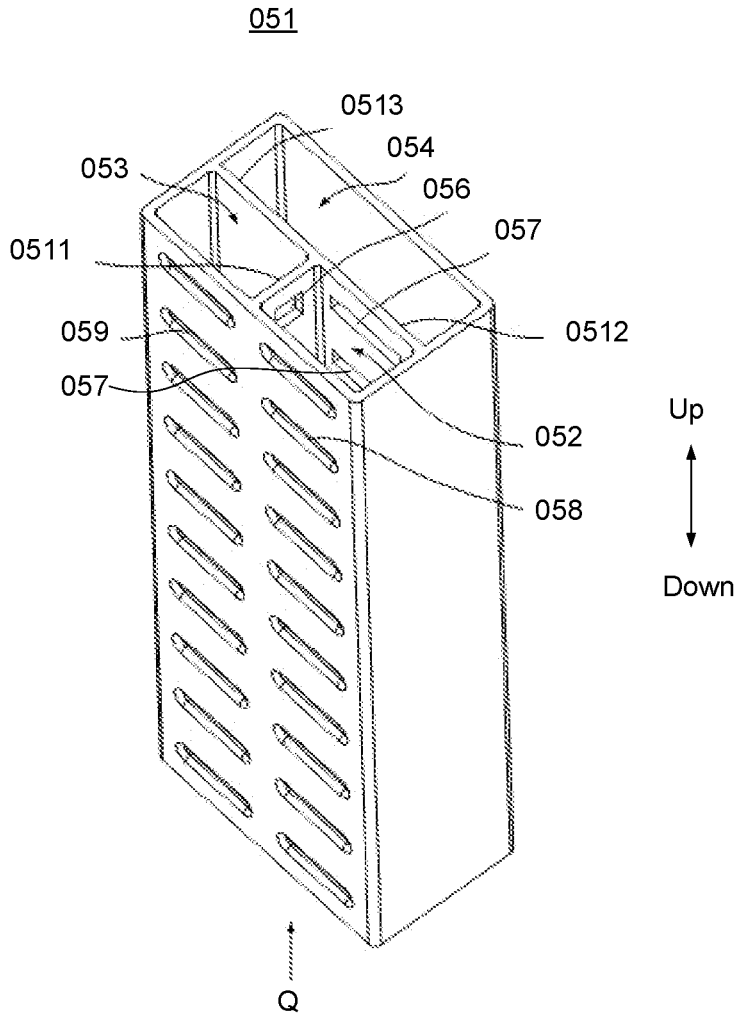
FIG. 22 is a diagram showing a structure of an intermediate header, in accordance with some embodiments.
Figure 23:
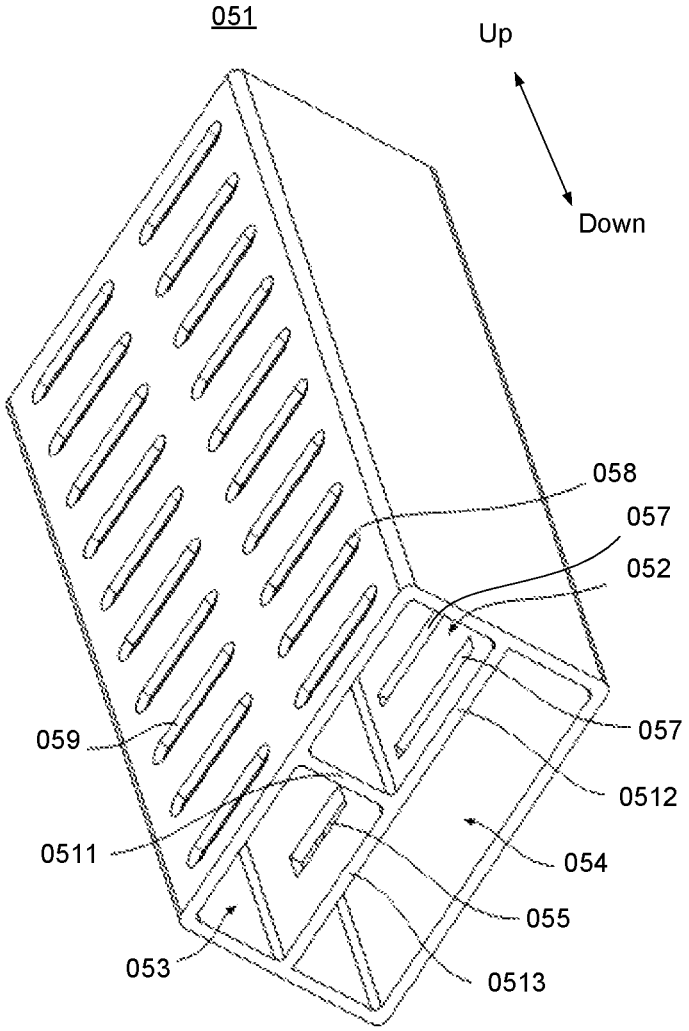
FIG. 23 is a perspective view of the intermediate header observed from a Q direction in FIG. 22.
Figure 24:
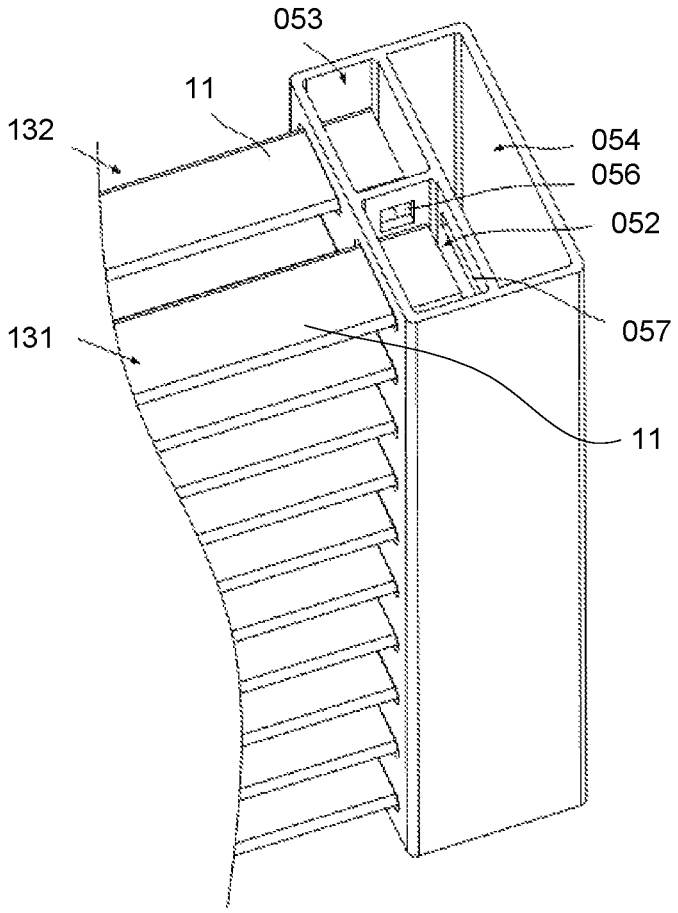
FIG. 24 is a partial structural diagram of an intermediate header communicating with flat tubes, in accordance with some embodiments.

FIG. 22 is a diagram showing a structure of an intermediate header, in accordance with some embodiments. FIG. 23 is a perspective view of the intermediate header observed from a Q direction in FIG. 22. FIG. 24 is a partial structural diagram of an intermediate header communicating with flat tubes, in accordance with some embodiments.

As shown in FIG. 22, each sub-cavity 051 includes a first cavity 052, a second cavity 053, a third cavity 054, a first flow-through portion 055, a second flow-through portion 056 and a third flow-through portion 057.

As shown in FIG. 24, the first cavity 052 communicates with a part of flat tubes 11 in the first-row heat exchange portion 131. The second cavity 053 communicates with a part of flat tubes 11 in the second-row heat exchange portion 132. The third cavity 054 communicates with the first cavity 052 and the second cavity 053.

As shown in FIG. 23, the first flow-through portion 055 is located at a lower portion of a side of the second cavity 053 proximate to the third cavity 054, and is configured to communicate with the second cavity 053 and the third cavity 054. As shown in FIG. 22, the second flow-through portion 056 is located at an upper portion of a side of the second cavity 053 proximate to the first cavity 052, and is configured to communicate with the first cavity 052 and the second cavity 053. The third flow-through portion 057 is located on a side of the first cavity 052 proximate to the third cavity 054, and is configured to communicate with the first cavity 052 and the third cavity 054.

In a case where the heat exchanger 6 is used as an evaporator, the gas-liquid two-phase refrigerant first enters the first cavity 052. Most of the gas-liquid two-phase refrigerant in the first cavity 052 flows into the third cavity 054 through the third flow-through portion 057. The gas-liquid two-phase refrigerant entering the third cavity 054 tends to separate due to gravity and the uniformity thereof will decrease. The gas-liquid two-phase refrigerant in the third cavity 054 enters the second cavity 053 through the first flow-through portion 055 in a lower portion. Since the flow velocity of the gas-phase refrigerant is higher than that of the liquid-phase refrigerant, the gas-phase refrigerant in an upper portion of the third cavity 054 will mix with the liquid-phase refrigerant in the lower portion when flowing downward through the first flow-through portion 055, and then the mixture will enter the second cavity 053 through the first flow-through portion 055, and flow into the flat tubes 11 communicating with the second cavity 053 from bottom to top, thereby achieving uniform distribution of the gas-liquid two-phase refrigerant in the flat tubes 11.

In a process of flowing from bottom to top in the second cavity 053, a velocity of the gas-liquid two-phase refrigerant decreases, and a vortex is formed in an upper portion of the second cavity 053. A flow rate of the gas-liquid two-phase refrigerant in the flat tube 11 at the vortex is small. The second flow-through portion 056 will guide the excess gas-liquid two-phase refrigerant in the upward flow path into the first cavity 052. The excess gas-liquid two-phase refrigerant will be mixed with the high-speed gas-liquid two-phase refrigerant in the first cavity 052, and then enter the distribution process of a next cycle of the gas-liquid two-phase. In this way, the distribution uniformity of the gas-liquid two-phase refrigerant may be further improved, and the heat exchange effect of the air conditioner 1000 may thus be improved.

In some embodiments, an opening size of the first flow-through portion 055 is larger than an opening size of the flat tube 11, so that the gas-liquid two-phase refrigerant in the third cavity 054 may smoothly enter the second cavity 053 through the first flow-through portion 055.

As shown in FIGS. 22 to 24, the sub-cavity 051 further includes a plurality of first mounting portions 058 and a plurality of second mounting portions 059, and the plurality of first mounting portions 058 are disposed on a side wall of the first cavity 052 and configured to mount the flat tubes 11. A plurality of second mounting portions 059 are disposed on the side wall of the second cavity 053 and are configured to mount the flat tubes 11. The first mounting portions 058 and the second mounting portions 059 are located on a same side wall of the sub-cavity 051, so that the first-row heat exchange portion 131 and the second-row heat exchange portion 132 may form a side-by-side structure after being communicated with each other through the intermediate header 05. With this arrangement, the structure may be more compact, which contributes to reducing a volume of the entire heat exchanger 6.

In some embodiments, the first mounting portions 058 and the second mounting portions 059 may be insertion holes provided on the side wall of the sub-cavity 051, and the flat tubes 11 are matched (e.g., plugged) with the insertion holes, which facilitates installation.

The number of the first mounting portions 058 is the same as the number of the second mounting portions 059, so that the number of flat tubes 11 communicating with the first cavity 052 is the same as the number of flat tubes 11 communicating with the second cavity 053, so as to improve the uniformity of the gas-liquid two-phase refrigerant in the flat tubes 11 of different flow paths.

In some embodiments, as shown in FIG. 22, the sub-cavity 051 further includes a first partition plate 0511, a second partition plate 0512 and a third partition plate 0513. An interior space of the sub-cavity 051 is partitioned into a first cavity 052, a second cavity 053 and a third cavity 054 through the first partition plate 0511, the second partition plate 0512 and the third partition plate 0513.

The second partition plate 0512 is located in a same plane as the third partition plate 0513, and the first partition plate 0511 is perpendicular to the second partition plate 0512 and the third partition plate 0513. The second partition plate 0512 and the third partition plate 0513 are arranged symmetrically with respect to the plane where the first partition plate 0511 is located. In this way, the first cavity 052 and second cavity 053 may be formed with equal volumes, which facilitates uniform distribution of the gas-liquid two-phase refrigerant.

Figure 25:
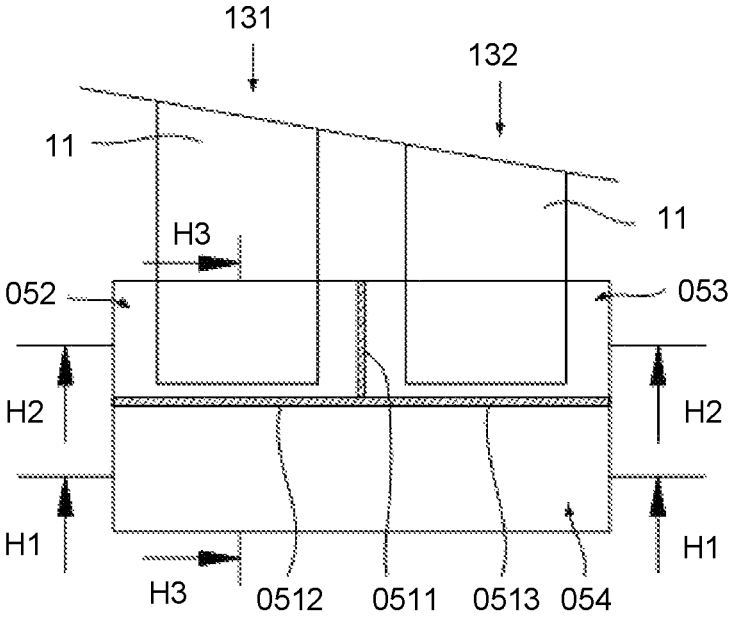
FIG. 25 is a top view of the intermediate header in FIG. 24 communicating with flat tubes, in accordance with some embodiments.
Figure 26:
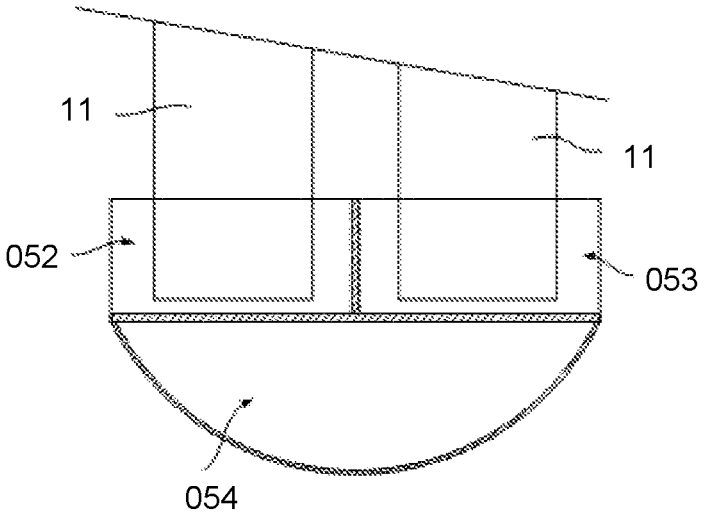
FIG. 26 is a top view of another intermediate header communicating with flat tubes, in accordance with some embodiments.
Figure 27:
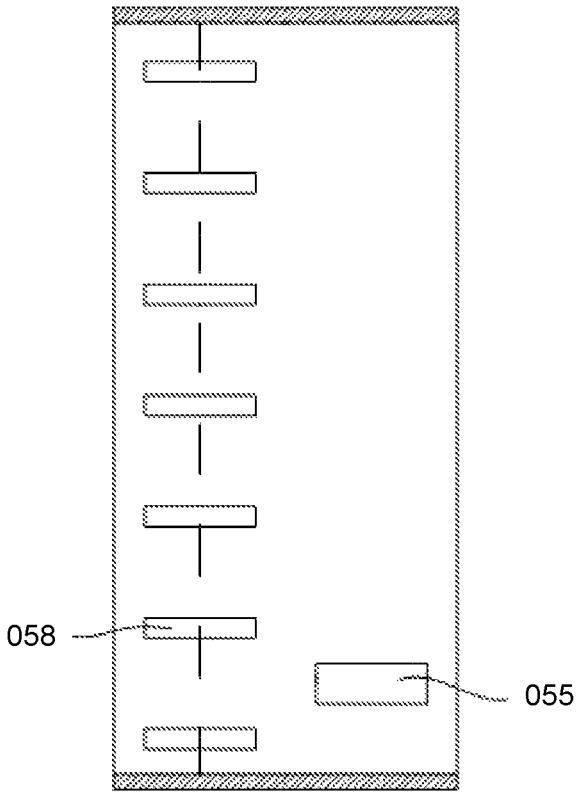
FIG. 27 is a cross-sectional view taken along the line H1-H1 in FIG. 25.
Figure 28:
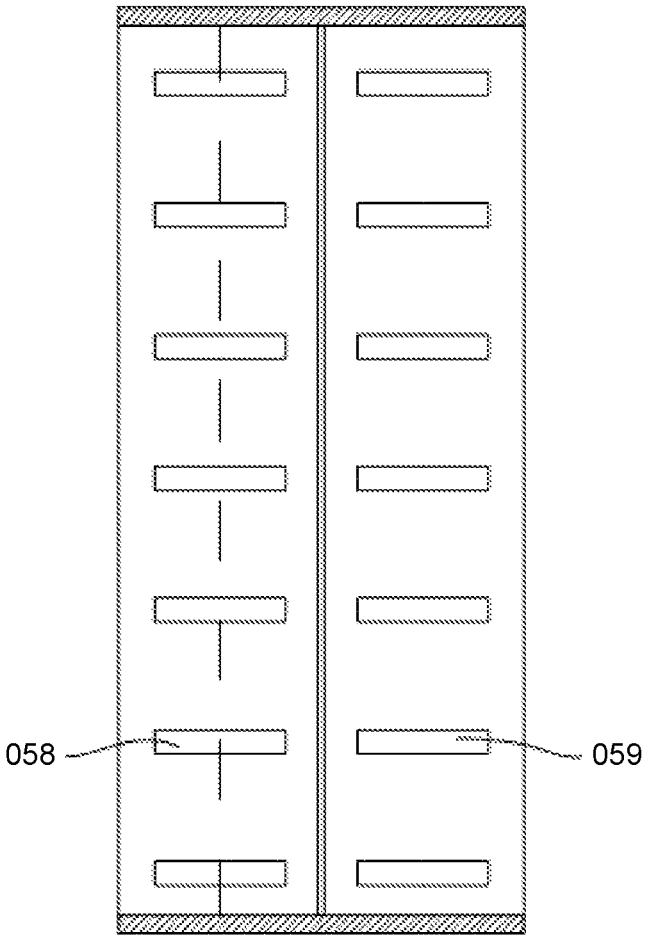
FIG. 28 is a cross-sectional view taken along the line H2-H2 in FIG. 25.
Figure 29:
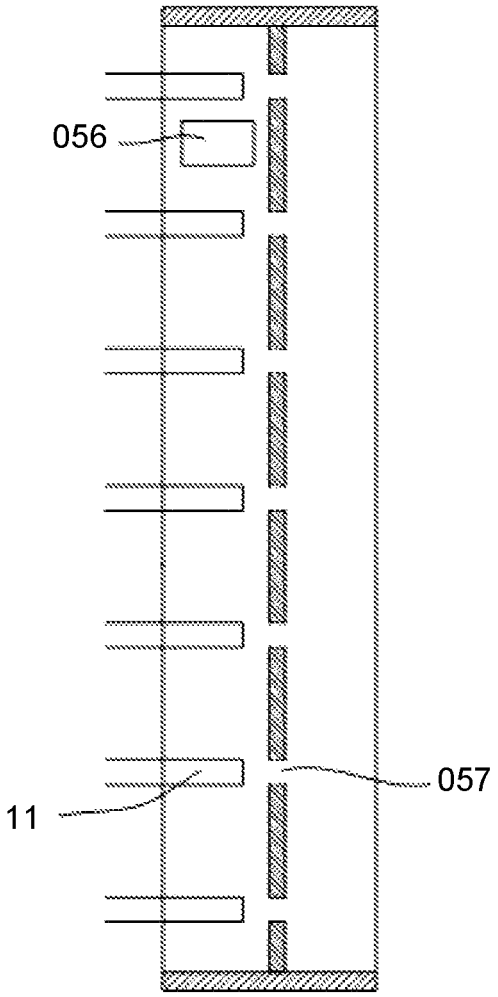
FIG. 29 is a cross-sectional view taken along the line H3-H3 in FIG. 25.

FIG. 25 is a top view of the intermediate header in FIG. 24 communicating with flat tubes, in accordance with some embodiments. FIG. 26 is a top view of another intermediate header communicating with flat tubes, in accordance with some embodiments. FIG. 27 is a cross-sectional view taken along the line H1-H1 in FIG. 25. FIG. 28 is a cross-sectional view taken along the line H2-H2 in FIG. 25. FIG. 29 is a cross-sectional view taken along the line H3-H3 in FIG. 25.

In some embodiments, as shown in FIGS. 22 and 25, the first partition plate 0511 is disposed between the first cavity 052 and the second cavity 053, and the second flow-through portion 056 is disposed at an upper portion of the first partition plate 0511. The second partition plate 0512 is disposed between the first cavity 052 and the third cavity 054. A plurality of third flow-through portions 057 for circulating the gas-liquid two-phase refrigerant are provided in the second partition plate 0512. The third partition plate 0513 is disposed between the second cavity 053 and the third cavity 054, and the first flow-through portion 055 is disposed at a lower portion of the third partition plate 0513.

The number of the third flow-through portions 057 is equal to the number of the flat tubes 11 communicating with the first cavity 052. There is a predetermined distance between an end portion of each flat tube 11 located in the first cavity 052 and the third flow-through portion 057, and the end portion directly faces a corresponding third flow-through portion 057, so that most of the gas-liquid two-phase refrigerant ejected from the flat tubes 11 may be injected into the third cavity 054.

In addition, the sub-cavity 051 shown in FIGS. 22 to 25 is substantially of a rectangular structure. Of course, in some embodiments, the sub-cavity 051 may also be other structures, for example, the first cavity 052 and the second cavity 053 of the sub-cavity 051 are substantially of a rectangular structure, and the third cavity 054 is of a D-type structure (as shown in FIG. 26), or of an O-type structure, the present disclosure is not limited thereto.

In a case where the gas-liquid two-phase refrigerant circulates between the first-row heat exchange portion 131 and the second-row heat exchange portion 132, no matter whether the gas-liquid two-phase refrigerant in the flat tubes 11 of the previous flow path is distributed evenly, after the gas-liquid two-phase refrigerant passes through the intermediate header 05, the dynamic regulation and uniform distribution of the gas-liquid two-phase refrigerant entering the flat tubes 11 of the next flow path may be achieved.

The foregoing descriptions are merely specific implementations of the present disclosure, but the protection scope of the present disclosure is not limited thereto. Any changes or replacements that a person skilled in the art could readily conceive of within the technical scope of the present disclosure shall be included in the protection scope of the present disclosure. Therefore, the scope of the present disclosure shall be subject to the protection scope of the claims.

What is claimed is:

1. An air conditioner, comprising:

a plurality of flat tubes configured to circulate a gas-liquid two-phase refrigerant, a flow direction of the gas-liquid two-phase refrigerant in a first part of the plurality of flat tubes being opposite to a flow direction of the gas-liquid two-phase refrigerant in a second part of the plurality of flat tubes;

a first header disposed at an end of the plurality of flat tubes, the first header including:

a first chamber communicating with the first part of flat tubes; and a second chamber communicating with the second part of flat tubes;

a second header disposed at another opposite end of the plurality of flat tubes, the second header including:

a header body communicating with the first part of flat tubes; and at least one flow disturbing portion disposed in the header body and configured to disturb a flow of the gas-liquid two-phase refrigerant in the header body;

a third header disposed at the another opposite end of the plurality of flat tubes and communicating with the second part of flat tubes;

a connecting pipe communicating with the header body of the second header and the third header;

a separator configured to separate the gas-liquid two-phase refrigerant into a gas-phase refrigerant and a liquid-phase refrigerant;

a gas distribution pipe group communicating with the separator and the second chamber and configured to circulate the gas-phase refrigerant; and a liquid distribution pipe group communicating with the separator and the second chamber and configured to circulate the liquid-phase refrigerant.

2. The air conditioner according to claim 1, wherein the second header further includes:

a cavity disposed at a bottom of the header body, the cavity communicating with the connecting pipe, the at least one flow disturbing portion being disposed in the cavity; and a channel disposed in the header body, an end of the channel communicating with the cavity, and another end of the channel communicating with the first part of flat tubes.

3. The air conditioner according to claim 2, wherein the at least one flow disturbing portion extends in a direction parallel to an inflow direction of the gas-liquid two-phase refrigerant entering the second header, and the at least one flow disturbing portion is spaced apart from inner side walls of the header body.

4. The air conditioner according to claim 3, wherein the at least one flow disturbing portion includes:

one flow disturbing portion; or, a plurality of flow disturbing portions, two adjacent flow disturbing portions of the plurality of flow disturbing portions being spaced apart.

5. The air conditioner according to claim 4, wherein when the at least one flow disturbing portion includes a plurality of flow disturbing portions, the plurality of flow disturbing portions include a first sub-flow disturbing portion and a second sub-flow disturbing portion, the first sub-flow disturbing portion and the second sub-flow disturbing portion being arranged symmetrically with respect to a position where the gas-liquid two-phase refrigerant enters the cavity; or the plurality of flow disturbing portions include a first sub-flow disturbing portion, a second sub-flow disturbing portion, and a third sub-flow disturbing portion, the first sub-flow disturbing portion and the second sub-flow disturbing portion being symmetrically arranged with respect to the position where the gas-liquid two-phase refrigerant enters the cavity and the third sub-flow disturbing portion disposed between the first and second sub-flow disturbing portions and extending in an inflow direction of the gas-liquid two-phase refrigerant entering the second header.

6. The air conditioner according to claim 2, wherein the second header further includes a plurality of inner walls spaced apart in the header body, the plurality of inner walls partitioning the channel into a plurality of sub-channels, an end of each sub-channel communicating with the cavity, another end of each sub-channel communicating with the first part of flat tubes.

7. The air conditioner according to claim 6, wherein the header body is in a shape of a cube, and each sub-channel is in a flat shape communicating with the plurality of flat tubes.

8. The air conditioner according to claim 2, wherein the channel includes:

a vertical sub-channel, an end of the vertical sub-channel proximate to the connecting pipe communicating with the cavity;

a horizontal sub-channel, an end of the horizontal sub-channel away from the connecting pipe communicating with the first part of flat tubes; and a bending sub-channel, an end of the bending sub-channel communicating with another end of the vertical sub-channel, another end of the bending sub-channel communicating with another end of the horizontal sub-channel.

9. The air conditioner according to claim 2, wherein the second header further includes:

an insertion portion disposed on a side wall of the header body, the first part of flat tubes communicating with the channel through the insertion portion.

10. The air conditioner according to claim 2, wherein the connecting pipe is disposed on a side of the cavity away from the plurality of flat tubes.

11. The air conditioner according to claim 1, comprising a plurality of second headers and a plurality of connecting pipes, wherein the third header includes:

a plurality of third partitions partitioning an interior space of the third header into a plurality of independent third chambers, a part of the plurality of third chambers communicating with the plurality of second headers through the plurality of connecting pipes.

12. The air conditioner according to claim 11, wherein one third chamber of the plurality of third chambers communicates with a part of the first part of flat tubes and a part of the second part of flat tubes;

a number of remaining third chambers of the plurality of third chambers is same as a number of the plurality of second headers, and the remaining third chambers communicate with the plurality of second headers in one-to-one correspondence through the plurality of connecting pipes.

13. The air conditioner according to claim 11, wherein an end of each connecting pipe communicates with a lower end of a corresponding third chamber, and another end of each connecting pipe communicates with a lower end of a corresponding second header.

14. The air conditioner according to claim 11, wherein of the third chamber and the second header communicating with two ends of a same connecting pipe of the plurality of connecting pipes, a number of flat tubes communicating with the third chamber is less than a number of flat tubes communicating with the second header.

15. The air conditioner according to claim 1, wherein the gas distribution pipe group further includes:

a gas distribution main pipe, an end of the gas distribution main pipe communicating with the separator; and a plurality of gas distribution branch pipes, an end of each gas distribution branch pipe communicating with another end of the gas distribution main pipe, another end of each gas distribution branch pipe communicating with the second chamber;

the liquid distribution pipe group includes:

a liquid distribution main pipe, an end of the liquid distribution main pipe communicating with the separator; and a plurality of liquid distribution branch pipes, an end of each liquid distribution branch pipe communicating with another end of the liquid distribution main pipe, another end of each liquid distribution branch pipe communicating with the second chamber.

16. The air conditioner according to claim 1, comprising:

a first-row heat exchange portion;

a second-row heat exchange portion, the second-row heat exchange portion and the first-row heat exchange portion being arranged in parallel in a direction perpendicular to an extension direction of the plurality of flat tubes; and an intermediate header communicating with the first-row heat exchange portion and the second-row heat exchange portion.

17. The air conditioner according to claim 16, wherein an interior space of the intermediate header is partitioned into a plurality of independent sub-cavities, and each sub-cavity communicates with a part of flat tubes in the first-row heat exchange portion and a part of flat tubes in the second-row heat exchange portion.

18. The air conditioner according to claim 17, wherein each sub-cavity includes:

a first cavity communicating with the part of flat tubes in the first-row heat exchange portion;

a second cavity communicating with the part of flat tubes in the second-row heat exchange portion and the first cavity; and a third cavity communicating with the first cavity and the second cavity.

19. An air conditioner, comprising:

a plurality of flat tubes configured to circulate a gas-liquid two-phase refrigerant, a flow direction of the gas-liquid two-phase refrigerant in a first part of the plurality of flat tubes being opposite to a flow direction of the gas-liquid two-phase refrigerant in a second part of the plurality of flat tubes;

a first header disposed at an end of the plurality of flat tubes;

a second header disposed at another opposite end of the plurality of flat tubes, the second header including:

a header body communicating with the first part of flat tubes; and at least one flow disturbing portion disposed in the header body and configured to disturb a flow of the gas-liquid two-phase refrigerant in the header body;

a third header disposed at the another opposite end of the plurality of flat tubes and communicating with the second part of flat tubes; and a connecting pipe communicating with the header body of the second header and the third header;

wherein the second header further includes:

a cavity disposed at a bottom of the header body, the cavity communicating with the connecting pipe, the at least one flow disturbing portion being disposed in the cavity; and a channel disposed in the header body, an end of the channel communicating with the cavity, and another end of the channel communicating with the first part of flat tubes; the channel further including:

a vertical sub-channel, an end of the vertical sub-channel proximate to the connecting pipe communicating with the cavity;

a horizontal sub-channel, an end of the horizontal sub-channel away from the connecting pipe communicating with the first part of flat tubes; and a bending sub-channel, an end of the bending sub-channel communicating with another end of the vertical sub-channel, another end of the bending sub-channel communicating with another end of the horizontal sub-channel.

20. The air conditioner according to claim 19, wherein an extension direction of the vertical sub-channel is perpendicular to an extension direction of the cavity, and an extension direction of the horizontal sub-channel is parallel to an extension direction of the first part of flat tubes.

* * * * *